US007750218B2

(12) United States Patent
Stannard

(10) Patent No.: US 7,750,218 B2
(45) Date of Patent: Jul. 6, 2010

(54) VIBRATO BASED PERCUSSION INSTRUMENT

(76) Inventor: John Stannard, c/o 2140 Range Rd., Unit C, Clearwater, FL (US) 33765

( * ) Notice: Subject to any disclaimer, the term of this patent is extended or adjusted under 35 U.S.C. 154(b) by 0 days.

(21) Appl. No.: 11/778,735

(22) Filed: Jul. 17, 2007

(65) Prior Publication Data

US 2008/0066607 A1 Mar. 20, 2008

Related U.S. Application Data

(60) Provisional application No. 60/831,625, filed on Jul. 18, 2006.

(51) Int. Cl.
*G10D 13/08* (2006.01)

(52) U.S. Cl. ..... 84/402; 84/411 R; 84/452 R

(58) Field of Classification Search ..... 84/102–104, 84/402–407, 410, 411 R, 416, 420
See application file for complete search history.

(56) References Cited

U.S. PATENT DOCUMENTS 2,189,095 A * 2/1940 Zildjian ..... 84/402
2,227,227 A * 12/1940 Mason ..... 340/392.5
4,114,502 A * 9/1978 Zildjian ..... 84/402
4,320,687 A * 3/1982 Kidwell ..... 84/402
4,807,510 A * 2/1989 Croteau ..... 84/402
6,034,313 A * 3/2000 Shelley ..... 84/422.3
6,310,277 B1 * 10/2001 Shelley ..... 84/422.3
6,915,756 B1 * 7/2005 McLachlan et al. ..... 116/148

* cited by examiner

*Primary Examiner*—Jeffrey Donels
*Assistant Examiner*—Christopher Uhlir
(74) *Attorney, Agent, or Firm*—Allen Dyer Doppelt Milbrath & Gilchrist

(57) ABSTRACT

A percussion instrument that produces a vibrato which is the most noticeable characteristic of the instrument. In one embodiment, the instrument is configured as a single two-dimensional curve, or a primary curve which is deeper or more pronounced than secondary curves along the surface of said instrument, and wherein said primary curve facilitates an oscillating flexing motion which produces an increase in the amplitude of the lowest frequency mode of vibration, the low pitch frequency modulates the whole of the spectrum of a musical sound by repeatedly raising and lowering said spectrum of sound in a periodic or oscillating manner, this effect being defined here as "vibrato". The instrument is suspended from one or more points, by means of an instrument supporting member or mounting device, rigid or flexible. The suspension or mounting points approximate the nodal area of the instrument.

21 Claims, 23 Drawing Sheets

VIBRATO BASED PERCUSSION INSTRUMENT

RELATED APPLICATION

This patent application claims the benefit of provisional patent application Ser. No. 60/831,625 filed Jul. 18, 2006.

FIELD OF THE INVENTION

The invention relates to percussion instruments which are adapted to create a vibrato phenomena.

BACKGROUND OF THE INVENTION

In order to have a better understanding of the invention, the following definitions are provided:

"Vibrato" is a phenomena wherein a low pitch frequency is introduced which modulates the whole of the spectrum of a musical sound.

Vibrato can also be defined as an effect wherein the frequency of a note or sound is quickly and repeatedly raised and lowered in a periodic or oscillating manner. In this invention some embodiments will raise the number of overtones as the instrument flexes or oscillates, thereby creating a periodic rise and fall in amplitude as well as frequency.

The rate of change in frequency, and the amplitude of the modulation all affect the character of vibrato. Vibrato can be quite subtle or quite pronounced. When the frequency of vibrato exceeds 20 cycles per second, it begins to be perceived as a note rather than a vibrato. Nonetheless, within the context of this invention, the same designs are present in such embodiments with higher frequency vibrato notes.

"Vibrato based instrument" is a hybrid percussion instrument in which the vibrato produced can be the most noticeable characteristic of the instrument.

While such instruments can be played in ways which minimize said vibrato, the instrument is capable of producing a vibrato of sufficient amplitude as to become the feature which sets the instrument apart to the greatest degree.

"Heat affected zone" is an area in a section of metal where heat has been applied which has altered the shape, crystalline or grain structure, hardness, rigidity, sound conductivity, elasticity, or other properties of said section. The effect of heat affected zones can be relatively limited in area or can affect the surrounding areas. The results of heat affected zones vary greatly depending on the alloy, thickness of section, shape of section and the staring temper or hardness of a given section.

"Overtones" are heard as simpler or individual tones or frequencies which when combined, make up the whole of a musical sound. The sum of simple sounds such as sine waves, rising and falling in amplitude and frequency can produce a complex sound. In cymbals and vibrato instruments, there is often a complex matrix of overtones comprising the whole.

"Swell" is a term in music and in describing cymbal and gong sound whereby sound grows in time from low to high amplitude. In cymbals, gongs and hybrid instruments, a rise in the frequency and complexity or number of overtones accompanies the rise in amplitude.

"Hybrid Instrument" (for purposes of this invention) is an instrument which, due to specific forming techniques, shapes, and materials, is capable of producing sounds similar to both cymbals and gongs.

"Attack" is the sound heard immediate after the striking of a percussion instrument. The attack is also defined as amount of time it takes for the sound of a percussion instrument to reach full volume or amplitude after a single strike. An instrument with a large amount of swell (such as a large gong struck with a soft mallet) would have a slow attack. An instrument such as a bell struck with a metal clapper or a triangle would have a fast attack.

SUMMARY OF THE INVENTION

This invention comprises the creation of a percussive musical instrument class which increases the volume (amplitude) of vibrato and can lower vibrato frequency—(to subsonic levels if desired) to create a pronounced vibrato effect which can serve to modulate the whole or composite sound of the instrument.

While such instruments can be played in ways which minimize said vibrato, the instrument is capable of producing a vibrato of sufficient amplitude as to become the feature which sets the instrument apart to the greatest degree.

A wide range of vibrato frequencies can be achieved with various embodiments of the invention from subsonic or very slow to medium range frequencies of hundreds of cycles per second using the frequency controlling factors described.

The vibrato can be of a singular oscillating sound or a complex series of "compound vibrato" sounds which simultaneously vibrate at differing frequencies.

The amplitude and overtone structure of the instrument can also vary according to described designs.

The result in all these cases is a novel musical instrument in which the vibrato can range from subtle to quite pronounced. In some embodiments of this invention, the vibrato is so pronounced as to become the central focus of the musical sound heard.

Material:

The preferred material will be of considerable elasticity. It will thus resist permanent deformation during vigorous striking. The material will however be easily deflected or temporarily flexed. This ease of flexing without permanent deformation is critical to the design of the invention. Metal possessing these qualities performs very well but other materials such as plywood, hard plastics, and composites also are capable of producing a form of the effect described Shape of the Invention and Location of Suspension Area:

The shape of the instrument is critical to the invention. The invention can be initially formed from material in the shape of a fiat plane. The material is then bent, or formed into a shape which takes one or more specific curves along said plane.

A slight, partial dome shape, seen as a slight secondary curve in directions other than the primary curve, is an acceptable feature, but a more pronounced (primary) curve will exist in a single direction to produce the distinctive "vibrato" of this invention. As said secondary curves become more pronounced, the resulting increase in general rigidity will raise the frequency and can reduce amplitude of the vibrato. This can be useful but if the secondary curves become too pronounced, the vibrato effect will be obliterated.

An even dome or semi-sphere (such as is found in cymbals) is found to be too rigid to create the vibrato mentioned.

When the form is a shape which is curved along one plane in a pronounced, two dimensional curve, this curve produces one mode of vibration of considerable amplitude and low frequency, and a pronounced vibrato effect can be achieved.

Tests show that the primary curve which causes a simple flexing motion favors a limited number of frequencies in the low spectrum. This oscillating flexion is the cause of the vibrato effect in this invention. When viewed from a frontal view or silhouette view, any shape can be used for this invention as long as the primary curve mentioned above as seen from a side view or top view features a considerably smaller radius (i.e.; deeper curve) than other curves or secondary radii. This curve is more visible from a side or top view than from a frontal view.

This invention has clearly defined nodes (areas of less vibration). The major nodal area relating to the fundamental tone which produces the vibrato is centered around an area which exists at a ratio of 23 percent of the length of the instrument. This nodal area is the preferred area to create holes for suspension.

Hence a 10" long instrument would ideally have one or more suspension holes at 2.3 inches from the end of the instrument. Deviation from this area to a small degree is acceptable but as the suspension point proceeds away from the nodal area, the vibrato effect has been found to become progressively less prominent and will eventually be obliterated.

In embodiments using flexible suspension members such as cord, where maximum amplitude, sustain and high frequency response are desired, the cord should extend upward along the CONVEX side of the curved instrument so that said cord only touches the instrument at the nodal area.

While nodes in percussion bars and bells are known in prior art, the discovery of suspension from the nodal area in combination with the primary curve to produce vibrato is an unexpected result unique to this invention. The location of suspension holes, striking method and the point on the invention struck have a marked effect on the amount of vibrato produced.

This invention has clearly defined antinodes (areas of greater vibration). Striking these areas excite the fundamental low frequency of the invention and hence produce a marked vibrato effect. The antinodes of this invention are located at both ends and also the center of the instrument. The ideal striking areas, when maximum amplitude of vibrato is desired, are the middle and either end. These areas represent antinodes (areas of high amplitude vibration) of the instrument.

A novel feature is that striking the invention in the nodal area from where the instrument is ideally suspended produces very little vibrato. This can be a useful area to strike as it can produce sounds similar to a cymbal when played with drumsticks. Striking in areas in between the nodal area and the antinode produce differing degrees of amplitude of vibrato. The ability to produce such changes in sound character instantly add to the potential for musical expression when playing this invention. When striking near the nodal area, bronze versions of this invention yield high frequencies similar to those heard in cymbals when played with drumsticks.

The type of striking tool used has an effect on vibrato amplitude. Marked vibrato effects can be produced by striking with the hand, or soft mallets. Drumsticks can also produce the vibrato effect. The edges of the invention can be played with triangle beaters at an acute angle to the edge to produce very high frequency longitudinal vibrations.

Large versions of this invention are also easily played with a violin bow to produce high frequency sounds.

One of the functional differences between this invention and a gong is the functional musical sound arising from this invention when played with drumsticks and bare hands. The prominent mid to high frequency overtone structure of many types of vibrato instruments, as well as their flexibility yields an instrument class which is easily played by drummers and percussionists alike.

Method and Materials of Suspension:

The invention can be suspended in two basic ways:

Suspension by means of any flexible member such as a cable, cord, spring, or chain can be used to suspend the invention. Suspension materials of the lowest possible mass will create the least dampening of vibration and result in the broadest overtone spectrum, general loudness or amplitude, and the longest sustain.

Suspension from any rigid member whereby the invention is attached directly to a stand such as a cymbal stand can still result in the vibrato effect, with reduced amplitude, high frequency response and a shorter sustain time. In such an embodiment, the instrument can feature a single mounting hole in the middle of the nodal area to facilitate balance when mounting rather than 2 holes or hooking devices which would normally be used for a suspended or hanging version of the instrument.

Both these methods can be useful in various musical passages.

Compound or Multiple Curves and Their Effect on Vibrato:

When raw material of any given length is curved along a singular primary curve, the use of said singular primary curve will produce the lowest frequency vibrato, however, a useful feature of multiple primary curves is that they can produce multiple vibrato modes of differing frequency simultaneously.

One such multiple curve configuration could be an S-shaped curve.

Frequency Shift Coinciding with Vibrato:

A periodic, oscillating shift in frequency and complexity of overtone structure occurs in this invention. The rate of shift in phase and overtone frequency is directly related to the frequency of the vibrato. As the invention flexes during a given cycle of vibration of the vibrato frequency, it becomes stiffer and produces higher frequency overtones. As it relaxes, it becomes less stiff and shows a reduction in frequency of overtones. The phase relationships of said overtones also changes during this periodic flexing, resulting in a highly complex overall sound.

Large embodiments of the invention, since they vibrate in more complex modes and yield a greater number of overtones, demonstrate this effect quite audibly.

Increased Overtone Complexity Arising from Slots, and Cantilevers Resulting from Slots, and Holes:

The creation of slots cut through the cross section of the metal, whether open ended (which sever the edge of the instrument and create cantilever sections) or closed slots which remain inside the perimeter of the instrument and do not sever its edge, or one or more holes in the instrument add overtone complexity by creating addition modes of vibration. The location of these alterations affects the frequency, amplitude, and overtones structure of the instrument.

Change in Mass at Key Points to Alter Frequency of Vibrato, Amplitude, and Overtone Structure:

The addition of weight at key points in the instrument can alter the frequency of vibrato and alter overtone structure, overall amplitude, and sustain of sound.

One method is to weld weights to the upper and lower ends of the instrument. The addition of weight at the ends will cause the instrument to oscillate at a different frequency of vibrato. In certain embodiments, addition of weight to upper and lower ends can increase overall loudness or amplitude. Depending on the design of weights, amplitude can be substantially increased by said addition of weights.

The weights can be bell or dome-shaped metal members which, while adding weight also ring or vibrate independently. Said bells or domes, when struck will also excite the main body of the instrument in sympathetic vibration, which adds a rich musical character to the sound of the bells. Similarly, striking the main body of the instrument will also excite the bells in sympathy. Another unexpected phenomena unique to this invention is that the main body of the instrument can cause a musically pleasing vibrato effect with the bell-weights themselves during the periodic flexion of said main body As the bells excite overtones within the main body of the instrument, the main body flexes which will raise and lower the frequency of said overtones in a manner which sounds like bells with a wide range of vibrato.

Another method of sound alteration is to suspend a removable weight from a cord or cable in the back of the instrument. Such a removable weight can be replaced by weights of differing mass for various changes in frequency of vibrato.

Another method is to fold metal at each end from a longer blank piece to form an instrument with added weight at each end. Such an instrument will have a lower frequency of vibrato and altered overtone structure.

Change in rigidity and Mass and its Effect on Frequency, Amplitude, and Overtone Structure:

Rigidity and mass of the section of material used to manufacture this invention directly affects the frequency of both the vibrato, and the overtones. The area where rigidity is altered greatly affects the amount and direction of change in frequency. Select areas can be made more or less rigid, resulting in pronounced changes in sound.

If the material is thinned by machining, milling, skiving, lathing, etching, or compressive thinning of the metal along a line, creating a groove, or the section is made narrower in the middle, that area becomes less rigid. If such a groove or narrow area bisects or crosses this invention across the middle area, the reduction in general rigidity will result in a lowering of frequency of vibrato and an alteration in overtone structure and amplitude. Grooves in other areas would affect a different type change in frequency and overtones. In thicker gauge vibrato instruments such grooves can result in a more pronounced vibrato, as well as a louder and longer sustaining instrument, as well as a novel change in overtone structure. If structural ribs or other shapes which stiffen the middle area are formed in or welded to this invention, an increase in vibrato frequency occurs.

Zones of Altered Rigidity and Hardness:

If isolated areas of the invention are altered in shape by dents, ribs, ridges, valleys, or other deviations from a smooth surface, the overtone structure of the instrument can become more complex. Such zones or areas can be created by hammering, pressing, forming or other shaping method which either compress or elongate the metal. Such operations can also alter the hardness and grain structure of the metal.

These areas of altered shape and hardness provide zones of differing rigidity and alter the vibrational characteristics and hence the overtone structure of the instrument. The general amplitude of the instrument can increase by the creation of said alterations to the instrument. The exact location, size, depth, and shape all affect the sound of the instrument in complex ways, some of which are virtually impossible to completely quantify, but in general, such zones increase overtone complexity, and can alter overall amplitude.

Another sound alteration method (which can be combined with the aforementioned forming methods is the creation of heat affected zones. If isolated zones of the metal instrument are subjected to heat treatment which can stress relieve, soften, harden or otherwise alter the grain structure of the metal, the overtone structure can be altered. In many alloys tested, such heat affected zones can add complexity to the overtone structure, increase general amplitude, and increase high frequency response of the instrument.

Depending on the alloy used, various forms of heat treating can be combined with said forming and surface shaping methods to achieve a desired sound.

Compressing or shrinking of formed alterations in surface can add complexity to the overtone structure.

Each general size and shape of instrument reacts differently to said alterations in ways that are virtually impossible to quantify, but instruments with such altered zones have a richer, more complex, and a more musically functional sound than instruments with a smooth, uniform metallic surface.

When isolated areas within a larger area of a metal percussion instrument are formed, hammered, heat treated, compressed, or otherwise altered, the sound propagation characteristics of the instrument are altered. One noticeable change is evident in the overtone structure of the instrument.

When a metal percussion instrument is hammered, shaped, or formed in a manner which creates a textured surface of multiple differing thicknesses, the complexity and number of overtones increases. The overall change in sound is quite complex but is universally regarded by musicians as being "more musical".

When a metal percussion instrument is hammered, shaped, or formed in a manner which creates a wavy or uneven surface, the complexity and number of overtones changes. When the surface is formed into many random and deeply shaped dents, bumps, ridges, or depressions, a reduction in the presence of the highest frequency overtones occurs.

While it is known that some of the aforementioned methods of surface alterations could add overtone complexity in cymbals, the unexpected and useful result is that the modulating effect of the vibrato, with its constant shifting of this heretofore unforeseen range of frequencies (resulting from the surface alterations) provides a decidedly interesting effect never before anticipated in prior art where simple strips of plain surface metal were shaken of struck to produce a percussive sound. This invention is capable of producing a sound complexity which actually can exceed that of cymbals and gongs.

Orientation of the Primary Curve:

Suspended versions of this invention can be curved in a manner which either present the primary curve being most visible from the top or from the side. The embodiment of the invention which produces the most pronounced vibrato features a primary curve which is visible from the side.

Nickel-Iron Grain Refiners in Bronze Percussion Instruments:

Ductility and strength are necessary to form the shapes in this invention. In many alloys, the metal is quite ductile (easily deformed without cracking or failure) when in the soft or partially softened state. These softer states of metal, while quite ductile, are not as strong as the hardened levels of temper in any given, alloy.

Temper ratings of certain alloys, especially those which are strengthened through cold work methods such as rolling, hammering or other methods which can reduce the thickness of said metal and reduce grain size and elongate the grain structure of the alloy, are rated by the percent of elongation remaining in the alloy before the metal will fell in tension.

Phosphor bronze is hardened and strengthened by cold work. Phosphor bronze alloys are typically composed of copper, tin and a small amount of phosphorous.

A typical phosphor bronze, when hardened to a strength rating of extra spring temper, can only be elongated by an additional 2% before failing and breaking or cracking in tension.

The addition of small amounts of iron and nickel can refine and reduce grain size and hence, increase strength. Through the addition of said iron and nickel, ideally in ranges of between 0.05 to 0.20% each, can increase strength considerably. By utilizing these grain refiners, a temper with more elongation remaining in the alloy can be used.

A temper rating of extra hard in such an alloy, will possess strength equal to extra spring in a typical bronze alloy. This extra hard temper can be elongated considerably more than extra spring temper hence allowing the deformation needed to easily form this invention.

In short the softer, a more ductile temper of grain refined bronze can be stronger than a hard, more brittle temper of traditional bronze.

While nickel iron grain refiners are known to increase low tin bronze strength, they are not known to increase sound quality. Low tin bronze alloys thought to be to high pitched, and of narrow range compared to equal, high tin alloys in sound quality. The inventor has found that by using nickel iron grain refiners in low tin, more affordable and workable alloys, a percussion or cymbal maker can increase taper, use of heat zones, depth and greater variations of hammering and other processes which create a structurally more complex instrument to realize a product of superior complexity of overtone structure, higher strength and a product which lends itself to greater affordability of quality control. Such processes such as greatly increased tapering would weaken common alloys but the added strength provided by nickel iron grain refiners allows the use of these special processes and features.

Many bronze instruments share many vibrational characteristics with cymbals. Advertising copy from the two largest cymbal manufacturers teaches away from use of low tin alloys for high quality percussion instruments by mentioning that their own product lines made of low tin alloys are of affordable, mass produced and identical quality when compared to their high tin alloy products: reference—Sabian.com advertising in referring to low tin alloy called B8 phrases point to an image of affordability, "rapid tech virtual cloning". Limited range of overtone structure is advertised: "focused sound," "Lowest possible prices," all teach away from low tin alloys for use in quality cymbals and percussion.

The Zildjian company (the leading cymbal maker) advertises "ultra modern crafting techniques", "higher pitch", "more focused overtones", "identical discs". Such phrases teach away from very high quality to cymbal and percussion consumers, who regard hand crafting and a wider range of overtones desirable, as currently described in its Web site at http://www.zildjian.com/en-US/products/default.ad2.

Conversely the same companies promote their high tin products as works of art with centuries old secret processes which yield high quality, all of which begins with their 20% tin alloy. The use of nickel-iron grain refiners in this invention offers a method to create new hybrid and vibrato based instrument embodiments of high quality and novel sound while possessing the superior flexural strength need for this invention.

In still another embodiment, a vibrato instrument can be configured to be formed of multiple bends or folds which are progressively sharper toward each end of the instrument. Essentially, this vibrato instrument can be formed with a series of bends or folds which serve to make the ends have an increase mass toward each ends while making the middle area lighter and more flexible. This will increase the amplitude and decrease the frequency of vibrato.

To summarize in more specific terms, the invention is a percussion instrument comprising means for enhancing the effect known as vibrato wherein a primary bend or curve is permanently formed in the material wherein said primary curve facilitates an oscillating flexing motion which produces an increase in amplitude of a lowest frequency mode of vibration. The low pitch frequency modulates the whole of a spectrum of a musical sound by repeatedly raising and lowering said spectrum of sound in a periodic or oscillating manner. The instrument can be suspended from one or more points, by means of flexible members, and the instrument is suspended from one or more points, by means of a flexible member. The points approximate the nodal area of the lowest frequency mode of vibration whereby such a location of suspension increases the amplitude of the vibrato the nodal area being located at a ratio between 0.15 and 0.30 times the overall length of said instrument.

In one embodiment, multiple primary curves or bends such as S-shaped or wave shaped bends or curves are provided.

In another embodiment, the instrument is suspended from one or more points and the points approximate the nodal area of the lowest frequency mode of vibration whereby such a location of suspension increases the amplitude of said vibrato said nodal area being located at a ratio between 0.20 and 0.25 times the overall length of said instrument.

In another embodiment, objects are fused or welded to one or both ends wherein the objects are adapted or configured and located to lower the frequency of vibrato of said instrument and/or alter the location of the nodal area and/or alter the overtone structure, or overall amplitude of said instrument. In a related embodiment, objects are fused, fastened, or welded to one or both ends wherein the objects are adapted or configured and located to lower the frequency of vibrato of said instrument, and/or alter the location of the nodal area, and/or alter the overtone structure, or overall amplitude of said instrument, wherein the objects act as independent vibrating members. Examples of such independent members include, but not limited to, domes, cantilevers, springs, cymbals or bells, and/or conduct vibration between the main body of the instrument and the vibrating objects (or weights) and are influenced by the oscillating flexion of the main instrument to create a bell or cymbal sound with vibrato. In another related embodiment, weight is added to one or both ends or corners by the bending, forming or folding of one or more ends or corners of the instrument, hence concentrating weight at the ends, wherein the weight can lower the frequency of vibrato of said instrument, alter amplitude, and/or alter the overtone structure of said instrument.

In another embodiment, material in a middle area of the instrument is altered by means of machining, abrading, etching, forming, hammering or other method of thickness alteration creating grooves or area of decreased thickness wherein the alterations increase ease of deflecting and can hence can lower the frequency of vibrato and/or alter the overtone structure and/or sustain of said instrument.

In another embodiment, the instrument further comprises one or more heat affected zones which alter the overtone structure of said instrument and generally alter the sound character of vibrato by causing a wider range of frequencies to be modulated by the vibrato effect.

In another embodiment, the instrument further comprises a series of hammered, formed, cast, machined, etched, or welded ridges, grooves, dents, raised areas, or general alterations to the plane of the surface, along said surface of the instrument, in which said alterations are less pronounced in the middle area, and more pronounced toward to upper and lower ends of the instrument, hence making the middle area more flexible and increasing the amplitude and decreasing the frequency of vibrato and altering the overtone structure of said instrument.

In another embodiment, the instrument further comprises a folded or flanged, or bent edge in one or more areas to facilitate increased amplitude of vibrato, especially when struck at an acute angle to the instrument, and reduce wear on the drumstick due to the rounded, smooth edge.

In another embodiment, a welded bead or rib of metal is fused, welded or formed in to the surface of the instrument in a manner which alters the rigidity, frequency of vibrato, attack or swell. or overtone structure or adds weight to one or more areas of said instrument. The beads or ribs are more flexible in the middle area of the instrument, by means of being of thinner gauge, or being located directionally to stiffen the upper and lower areas of the instrument more than the middle area.

In another embodiment, when the instrument is formed, there are formed a series of surface alterations comprising dents, where the dents or surface deformations are smaller or more sparsely located in the middle are of the instrument and larger or more densely located at the top and bottom areas, hence enhancing the vibrato effect by rendering the middle area more flexible due to said smaller or more sparsely located dents.

In another embodiment, the middle area is narrower than the upper and lower areas in a manner which lowers the frequency of vibrato and/or alters the overtone structure and/or the amplitude of the instrument.

The instrument is made from material comprising of a bronze alloy composed of 6 to 1.6 percent tin, said alloy containing between 0.02 to 0.50 percent each of nickel and iron for use as grain refining agents, between 0.005 and 0.70% phosphorous and less than 1% total trace elements, and the remainder copper whereby said alloy demonstrates an increase in flexibility or resistance to permanent deformation due to the addition of said nickel and/or iron grain refining elements, hence enhancing the ability of said instrument to produce high amplitude vibrato.

In another embodiment, the instrument comprises a series of open slots, extending from the outer edge inward, whereby said slots are of a shorter length in the bottom and top areas, and of increasing length toward the middle area, hence making middle more flexible, or a wavy cut which produces the same narrowing effect on the middle area to increase flexibility.

In another embodiment, a cymbal or bell and a vibrato section are fused at a common nodal area, with the nodal area of said vibrato section being located at 0.15 to 0.30 times the length of said vibrato section, and the nodal area of the cymbal or bell being located at the center of said cymbal or bell, wherein the fused sections share a common mounting hole.

In another embodiment, a primary bend or curve is permanently formed in the material wherein said primary curve facilitates an oscillating flexing motion which produces an increase in amplitude of a lowest frequency mode of vibration, wherein the low pitch frequency modulates the whole of a spectrum of a musical sound by repeatedly raising and lowering said spectrum of sound in a periodic or oscillating manner, wherein the instrument can be suspended from one or more points, by means of flexible or rigid members, and the points approximate the nodal area of the lowest frequency mode of vibration where such a location of suspension increases the amplitude of said vibrato said nodal area being located at a ratio between 0.15 and 0.30 times the overall length of said instrument wherein said instrument is made more flexible in the middle area in a manner in which said increased flexibility enhances the effect of vibrato.

In another embodiment, material in a middle area is altered by groups of holes whereby the holes increase ease of deflecting and can hence can lower the frequency of vibrato and/or alter the overtone structure of said instrument.

In another embodiment, the instrument further comprises one or more dented, pressed, deformed, bent, etched, machined, skived, abraded, compressed, grooved, slotted, folded, lathed, heat affected, or hammered zones which alter the overtone structure of said instrument and generally alter the sound character of vibrato by causing a wider range of frequencies to be modulated by the vibrato effect. The unexpected and useful result of such a deformation process is that the modulating effect of the vibrato, with its constant shifting of frequencies provides a decidedly interesting effect never before anticipated in prior art where simple strips of unaltered metal were shaken or struck to produce a percussive sound.

BRIEF DESCRIPTION OF THE DRAWINGS

In the accompanying drawings.

DETAILED DESCRIPTION OF THE INVENTION

Figure 1:
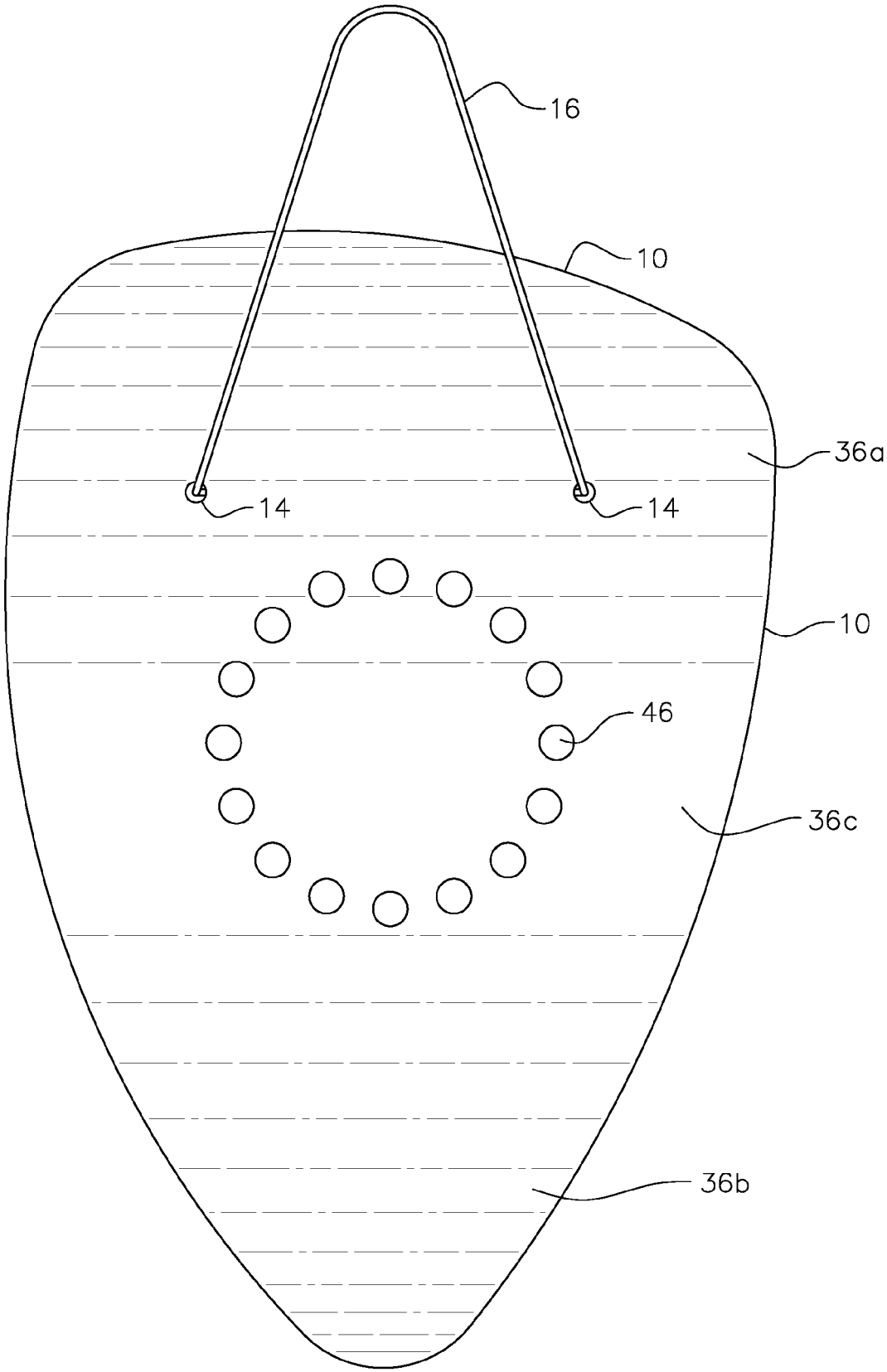
FIG. 1 is a frontal depiction of one embodiment of the vibrato instrument invention with a circular pattern of holes in middle area of the instrument.
Figure 2A:
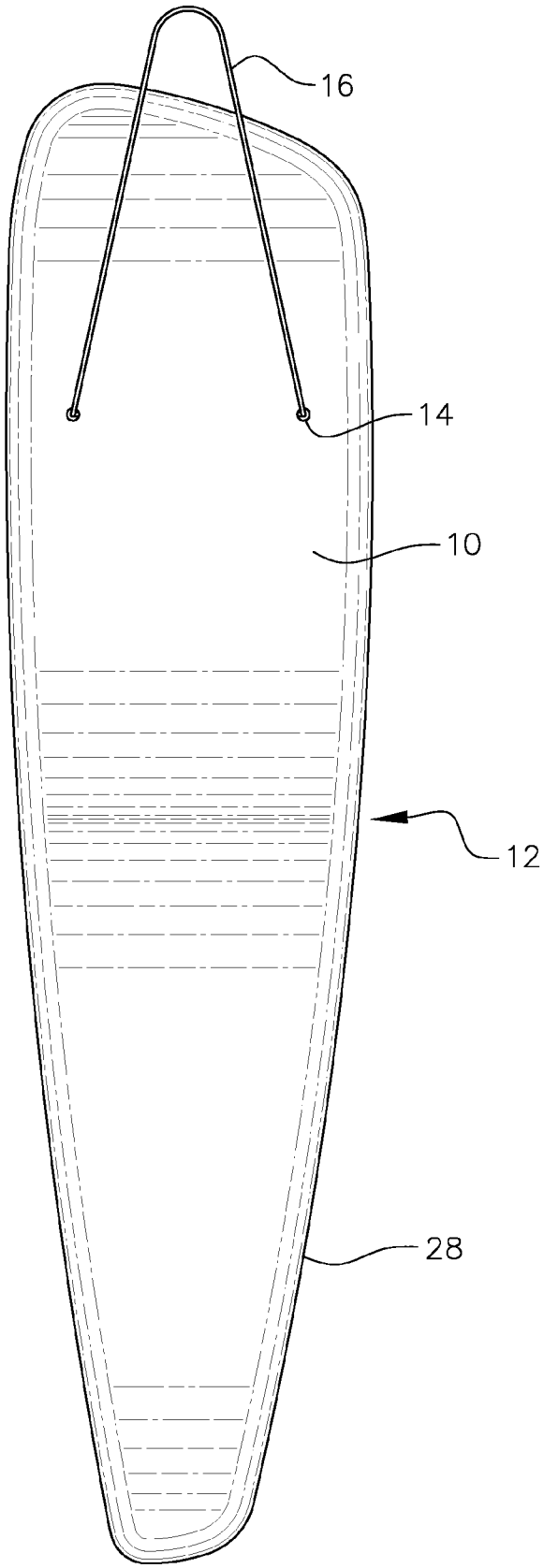
FIG. 2A is a frontal depiction of another embodiment of the invention, with multiple primary curve portions, in particular, an S-shaped curve and also a secondary curve, which is slight dome-shaped.
Figure 2B:
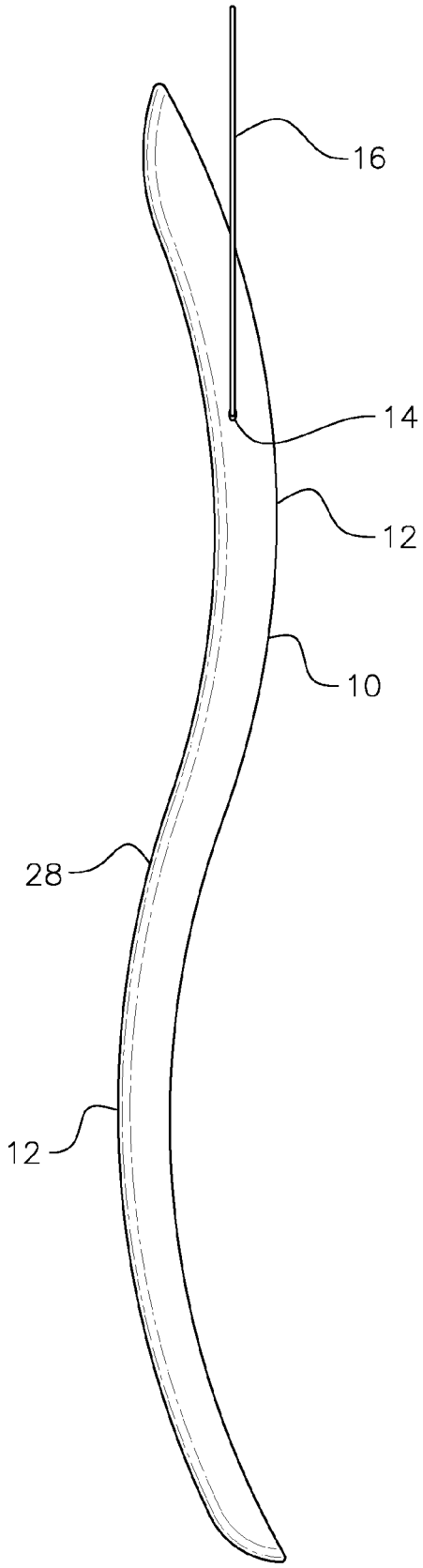
FIG. 2B is a side view depiction of FIG. 2A.
Figure 2C:
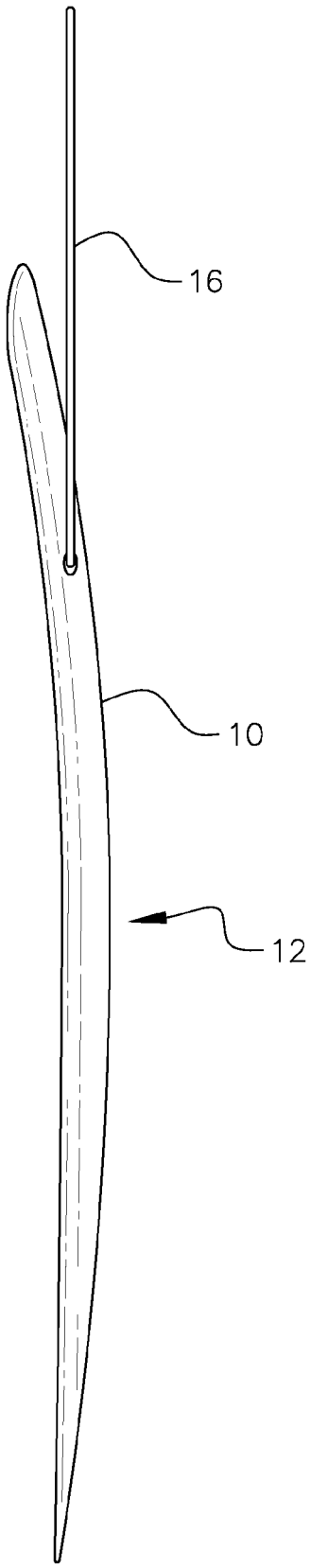
FIG. 2C is a side view of another embodiment of a vibrato instrument according to the invention.
Figure 2D:
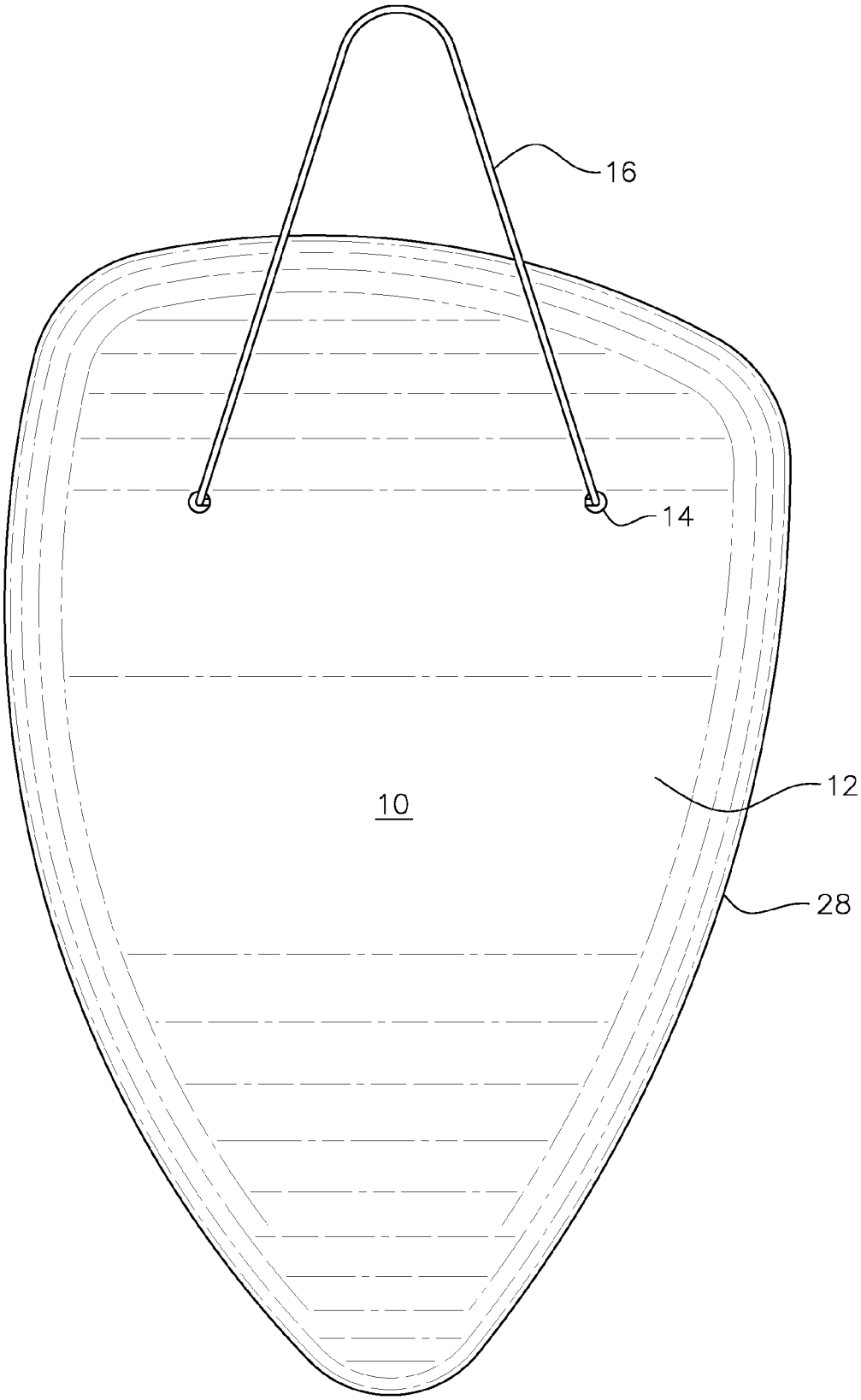
FIG. 2D is a frontal view of the instrument depicted in FIG. 2C.
Figure 3:
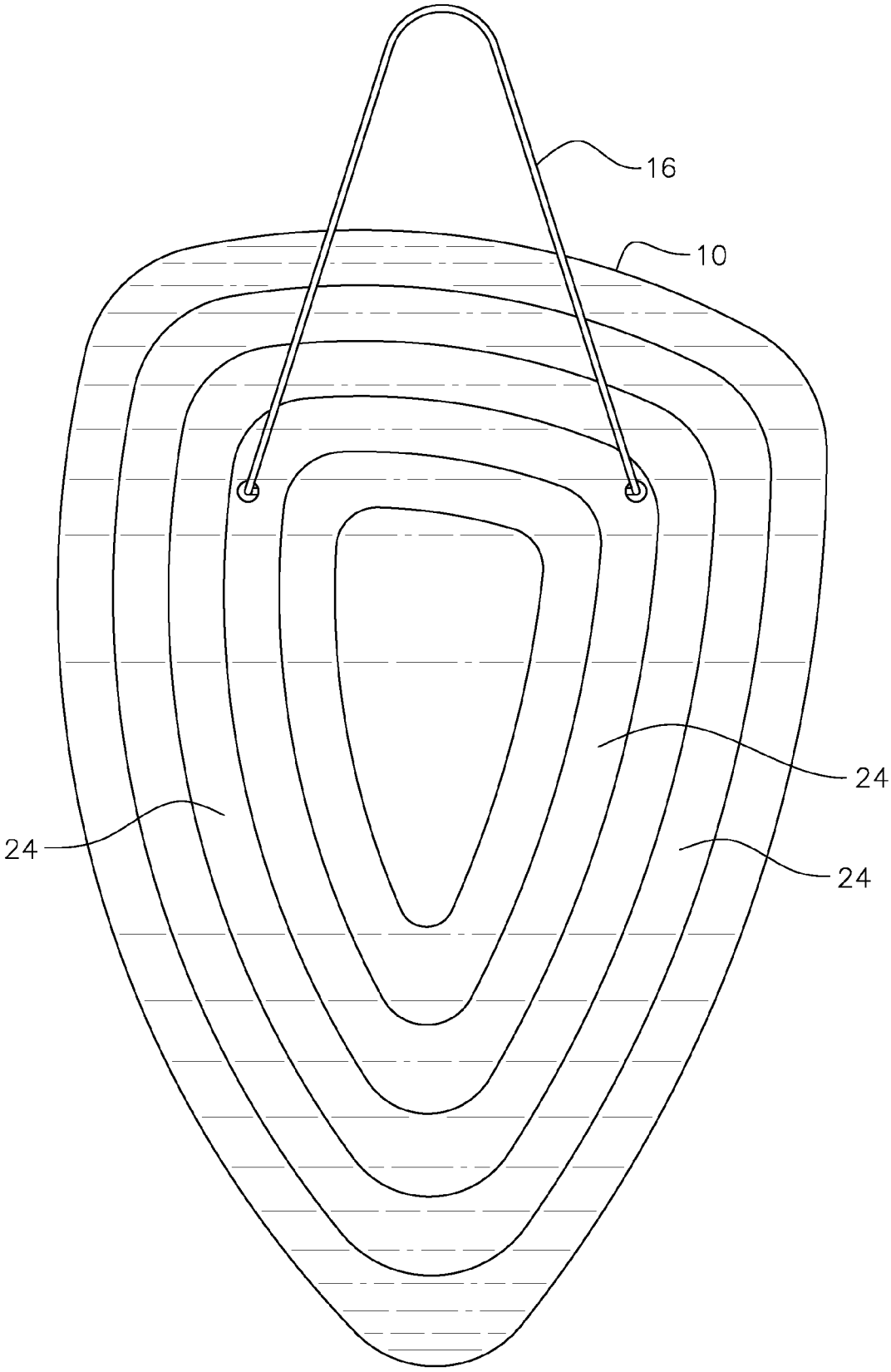
FIG. 3 is a frontal view of another embodiment of the invention wherein various heat affected zones in predetermined areas are shown.
Figure 4:
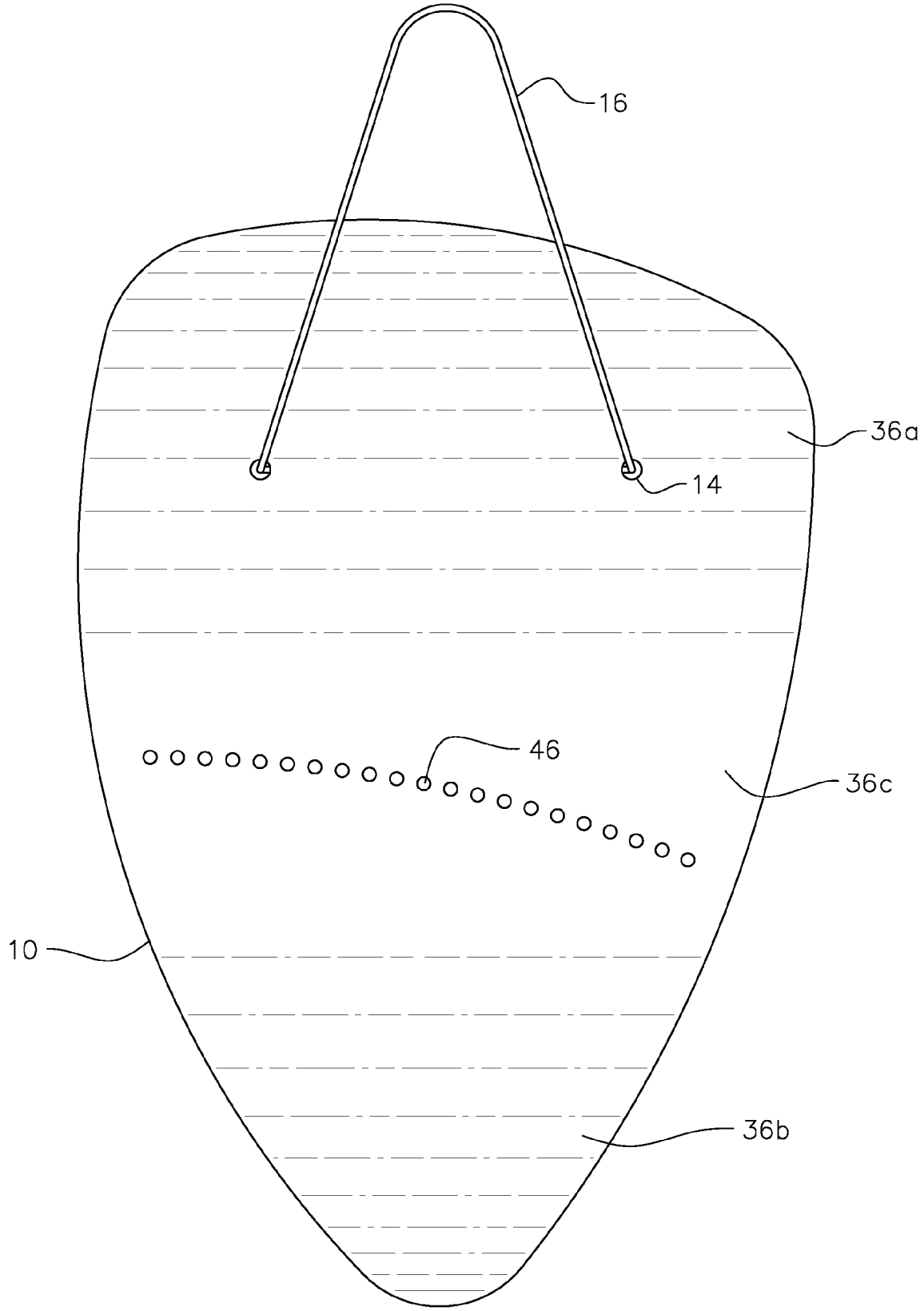
FIG. 4 is a frontal view of another embodiment of the invention incorporating spaced-apart holes in middle area of the instrument.
Figure 5A:
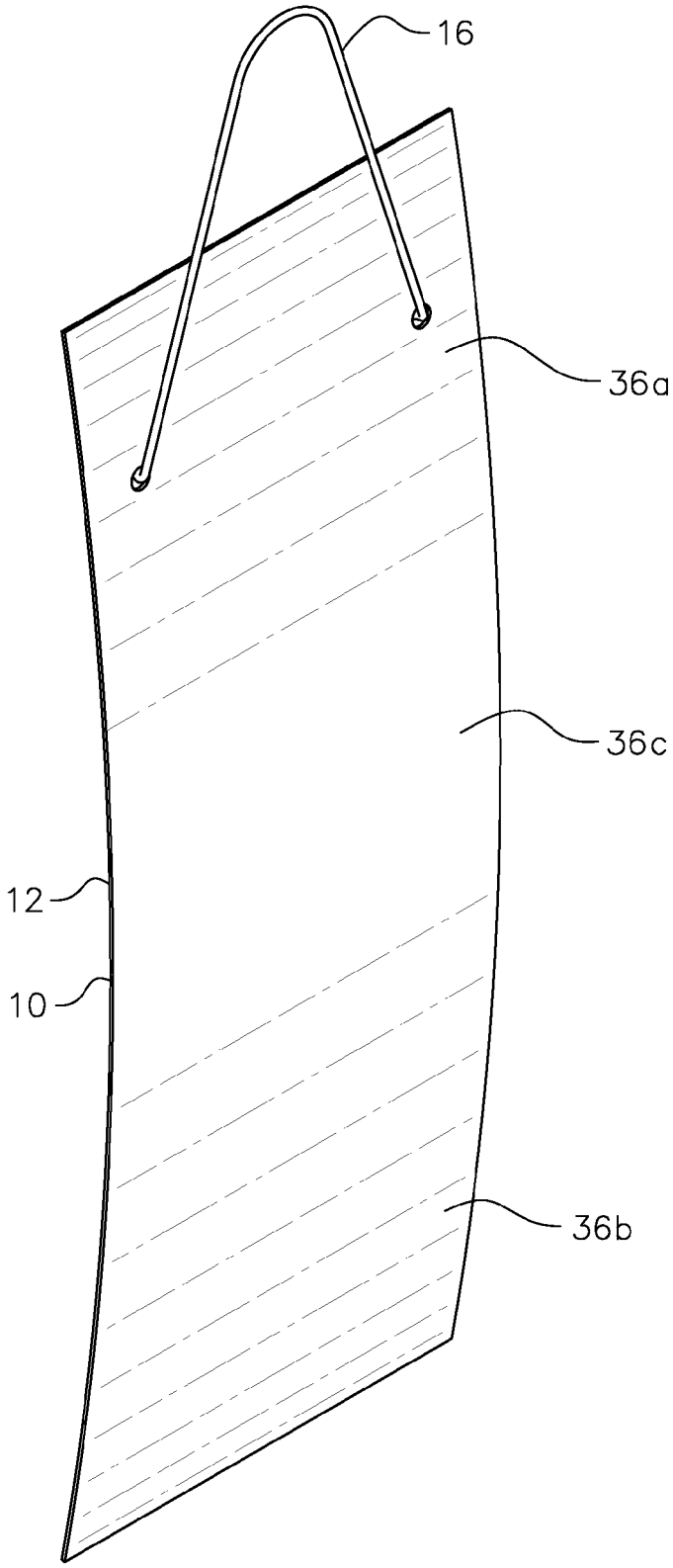
FIG. 5A is a perspective view of another embodiment of the invention without bent ends.
Figure 5B:
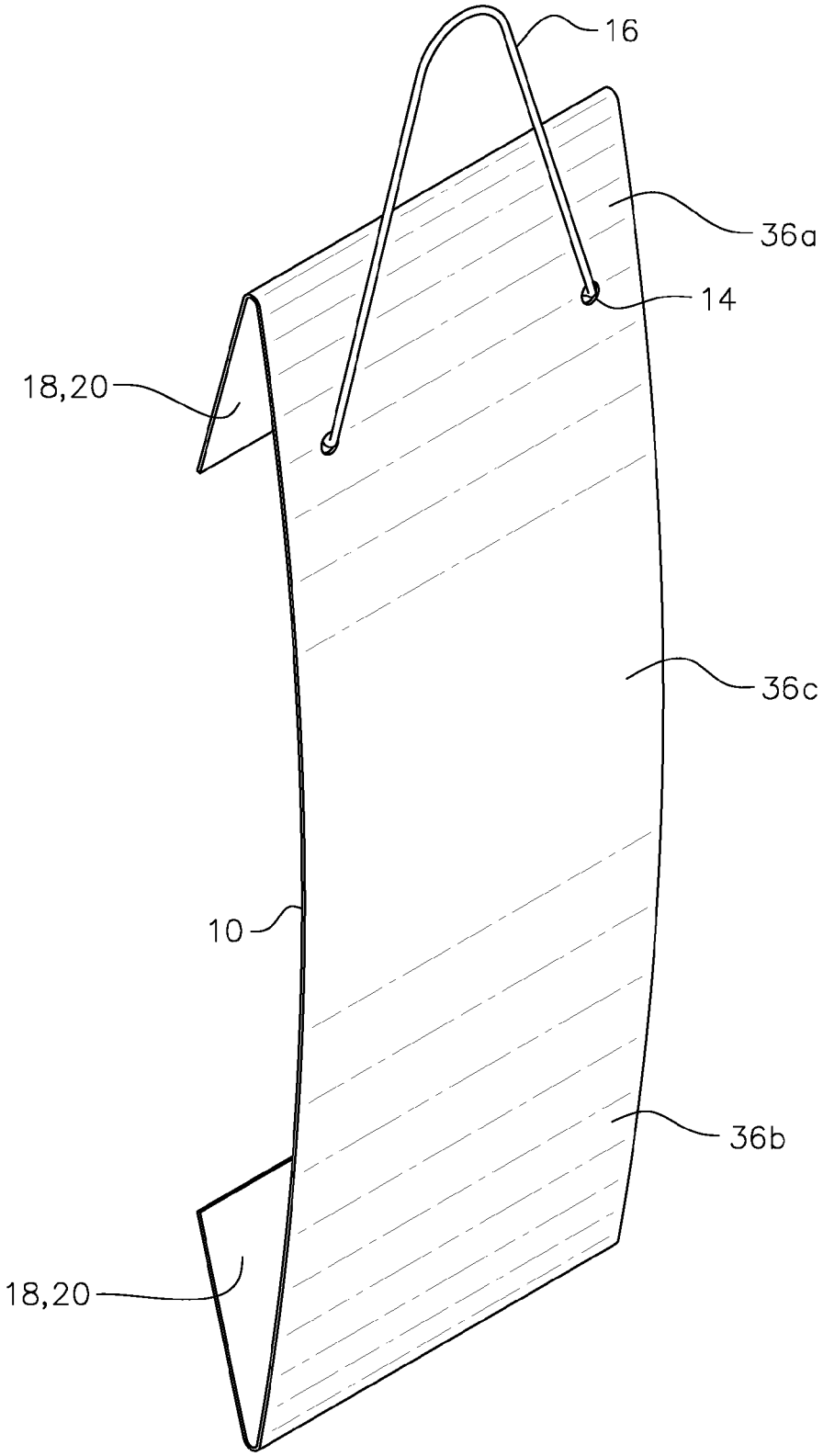
FIG. 5B is a corresponding perspective view of an embodiment similar to that depicted in FIG. 5*a* with a bent portion acting as weights at each end of the instrument or representing a weight portion added to each end of the instrument.
Figure 6A:
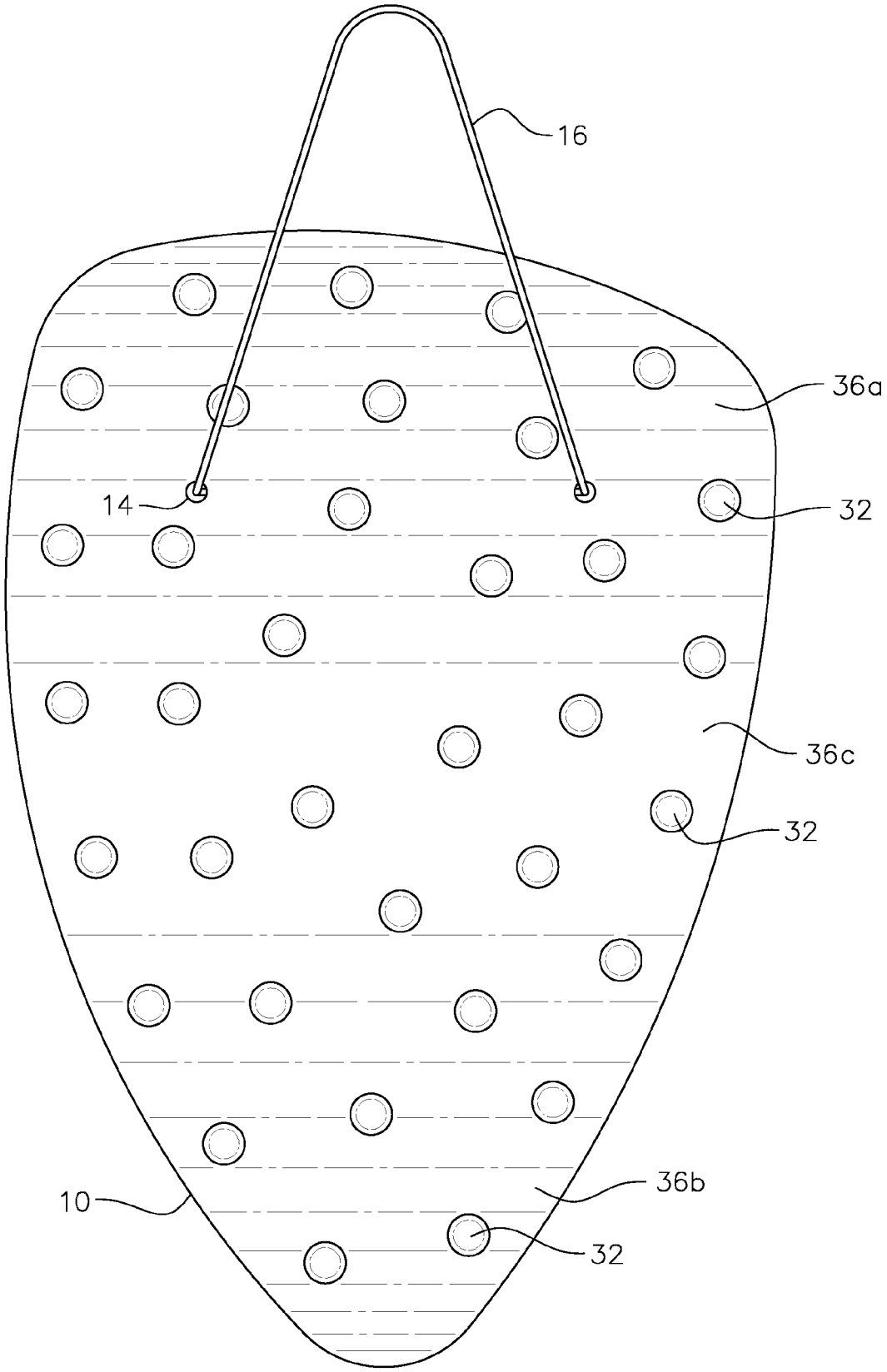
FIG. 6A is a representative depiction of another embodiment of the invention depicting spaced-apart dents on the surface of the instrument, which in the example, are evenly spaced.
Figure 6B:
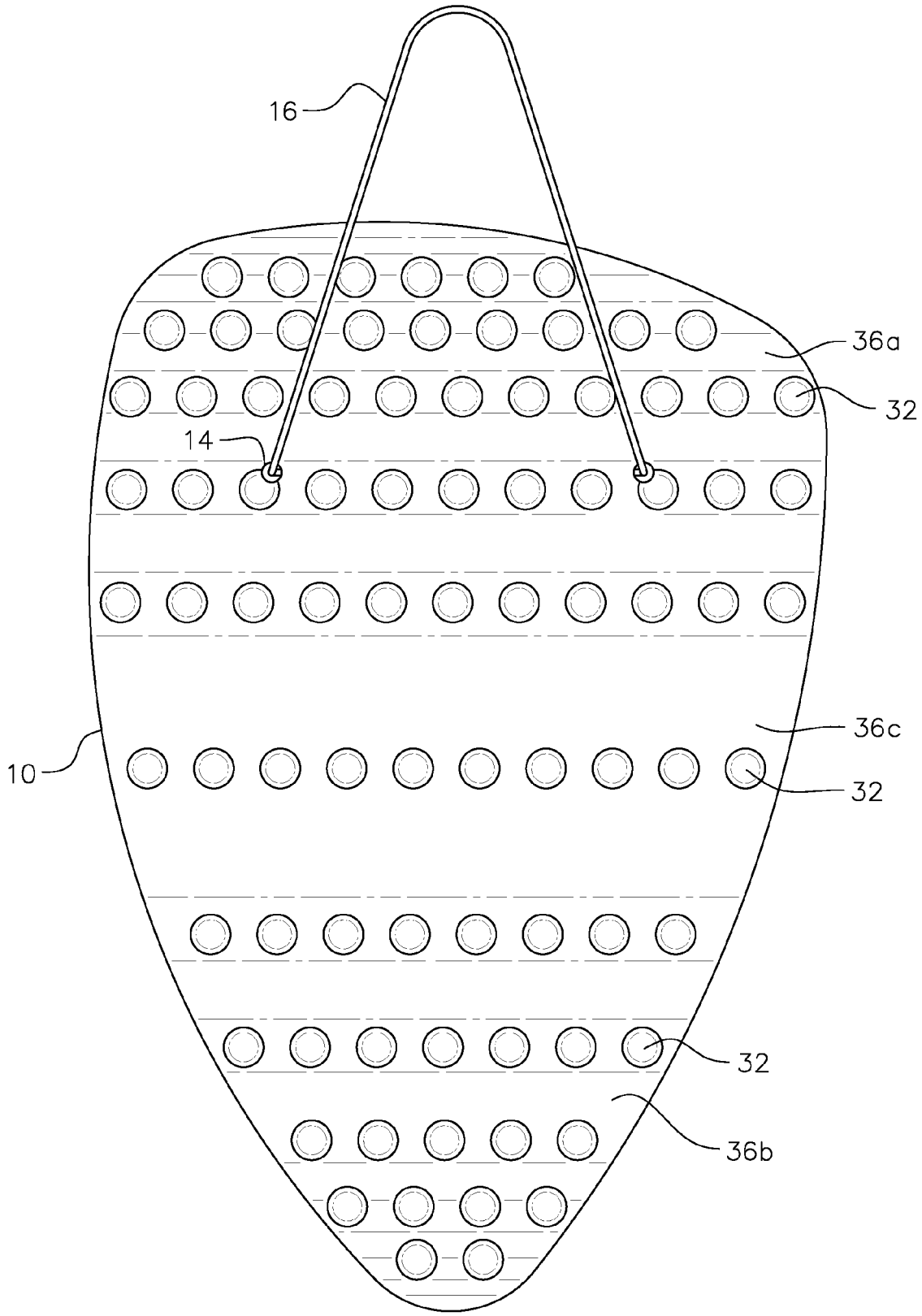
FIG. 6B is a representative depiction of another embodiment of the invention depicting spaced-apart dents on the surface of the instrument, which in the example, depict dents more densely spaced at the top and bottom portions of the instrument.
Figure 6C:
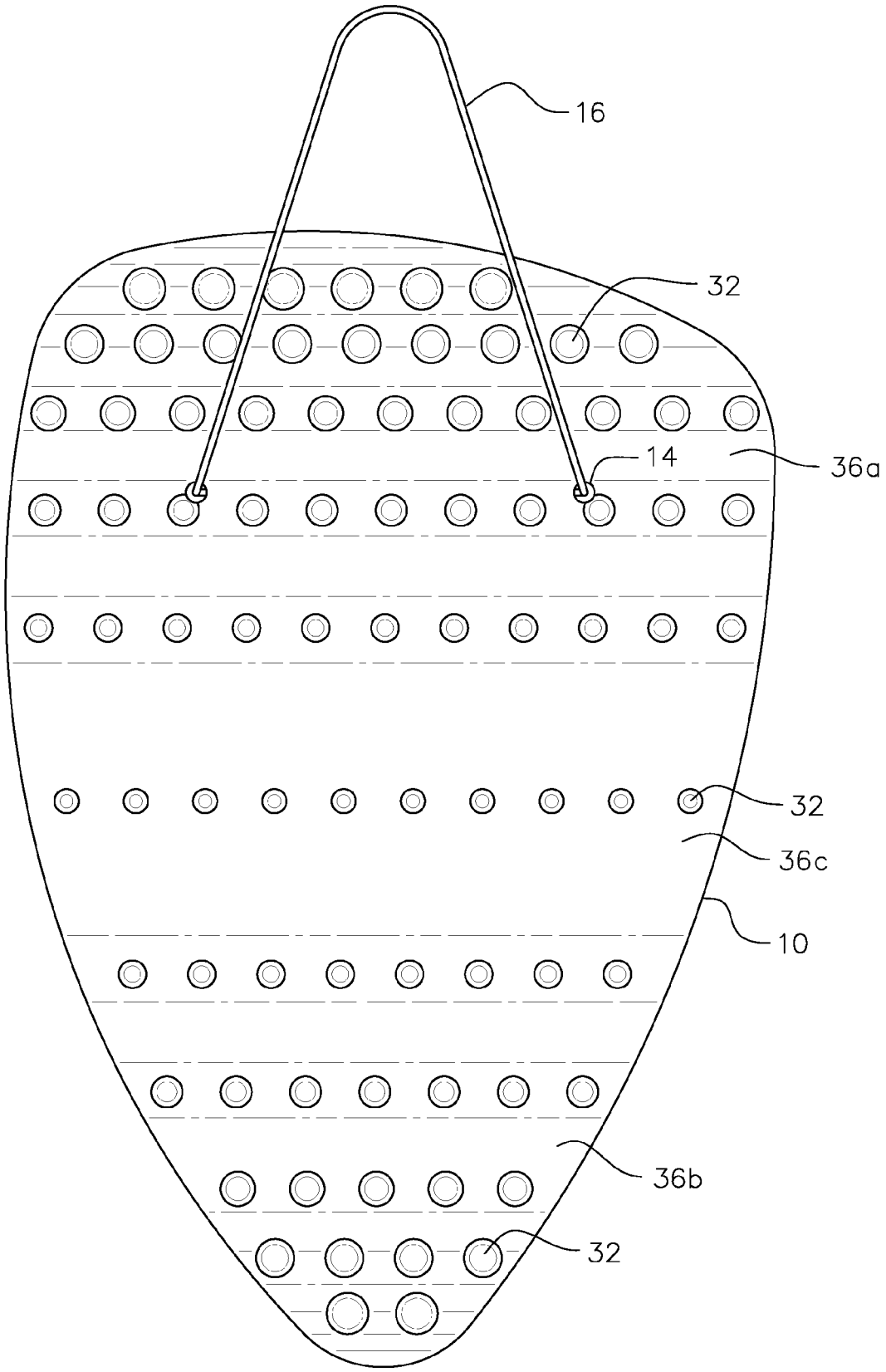
FIG. 6C is a representative depiction of another embodiment of the invention depicting spaced-apart dents on the surface of the instrument, which in the example, depict large or deeper dents at the top and bottom portions of the instrument.
Figure 7A:
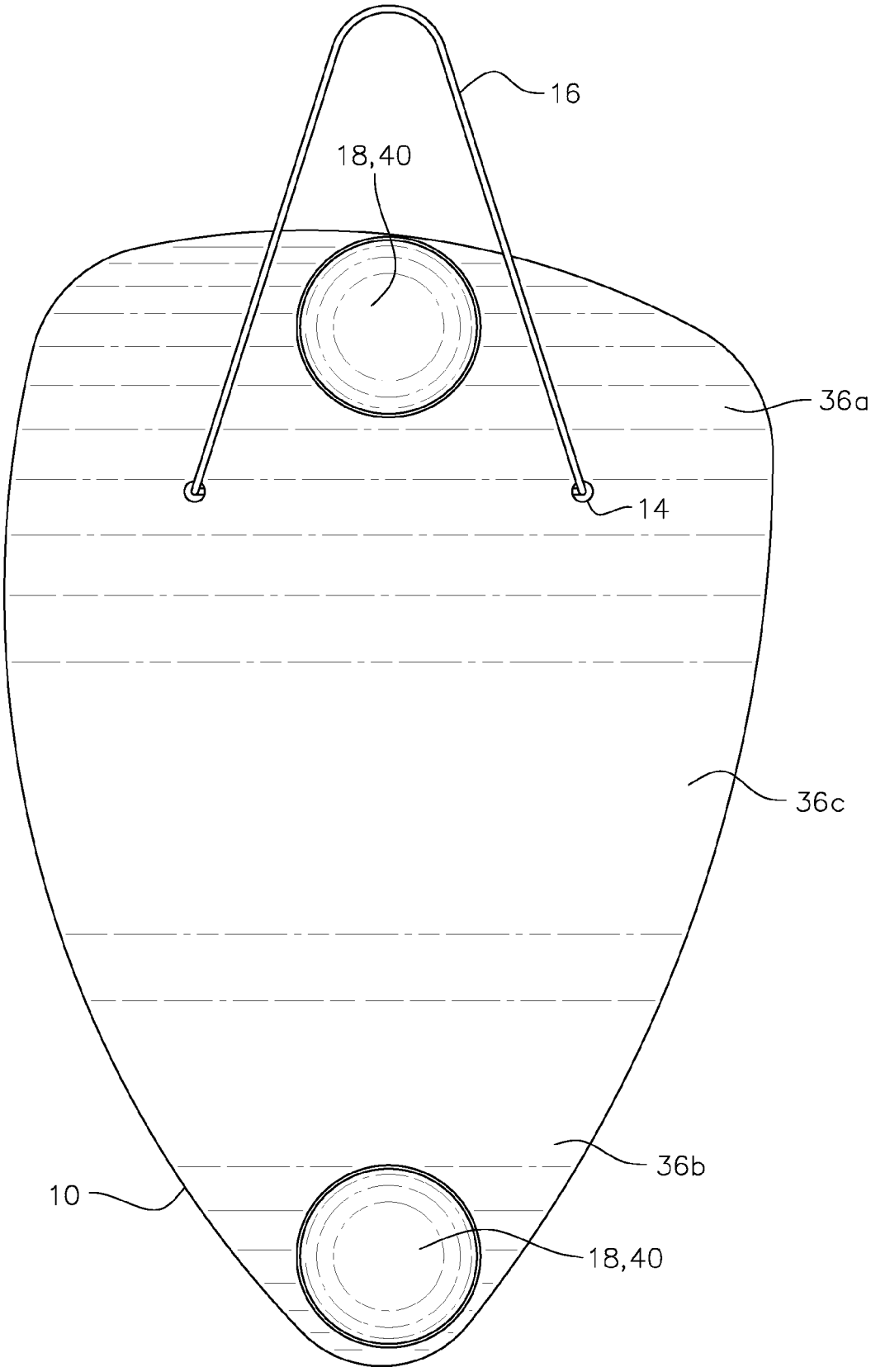
FIG. 7A, is a representative frontal view depiction of another embodiment of the invention, where in the example depicted, objects, including bells, cymbals, or domes are welded to the top and bottom portions of the instrument.
Figure 7B:
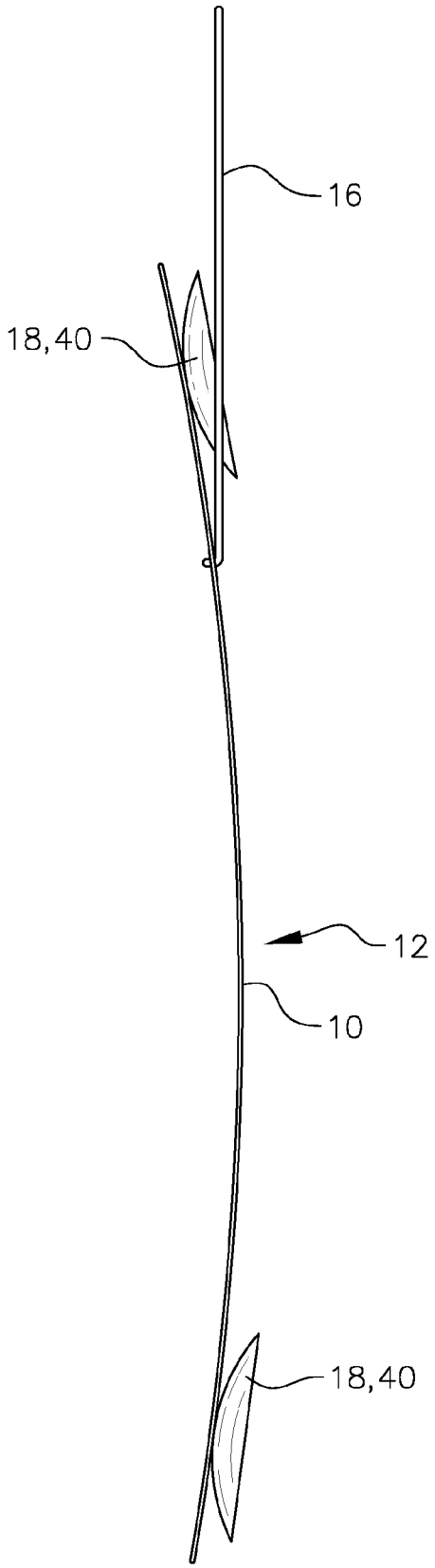
FIG. 7B is a side view depiction of the embodiment depicted in FIG. 7A.
Figure 8:
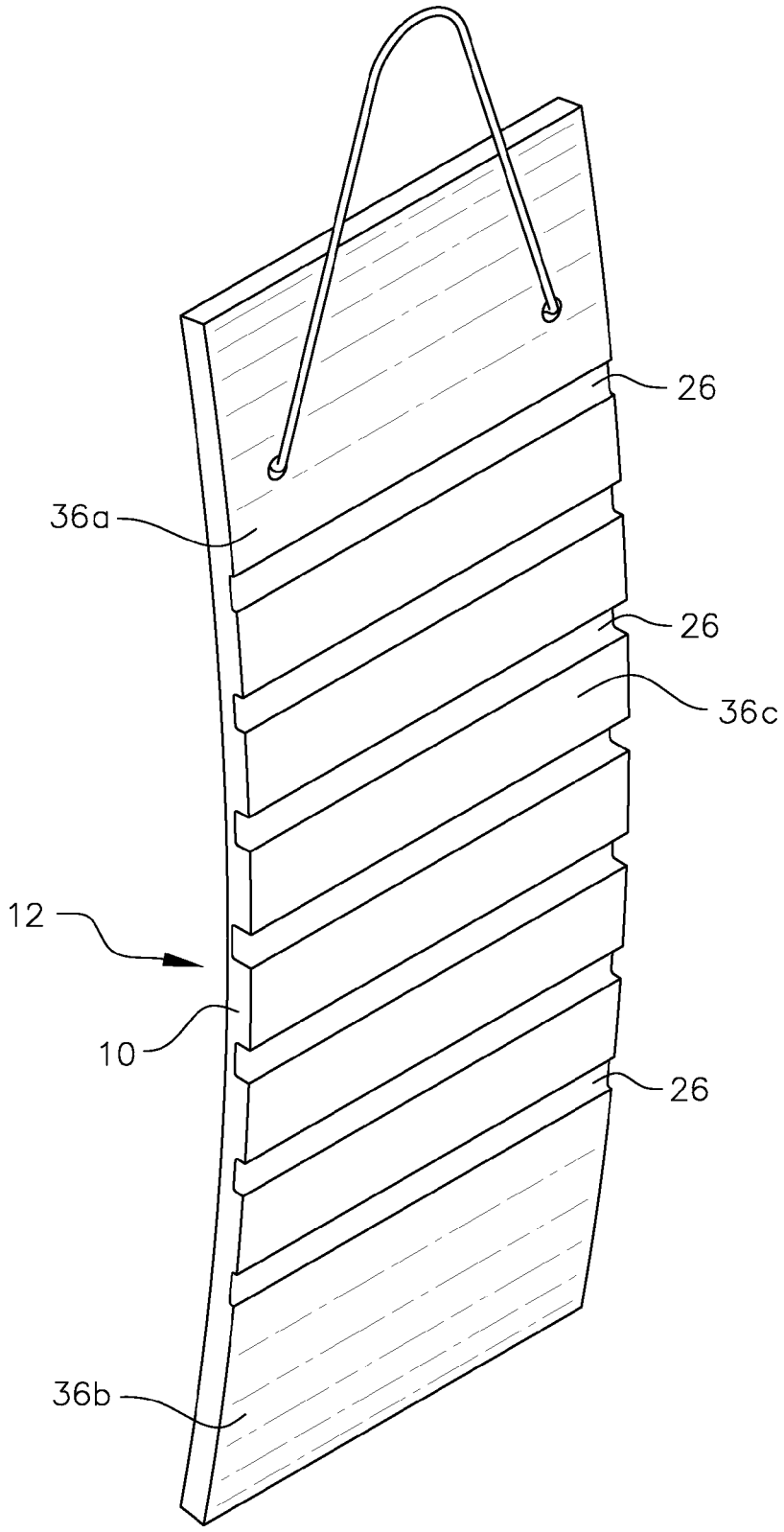
FIG. 8 is a perspective view of an example of another embodiment of the invention depicting grooves, which are progressively deeper toward the middle area of the instrument.
Figure 9:
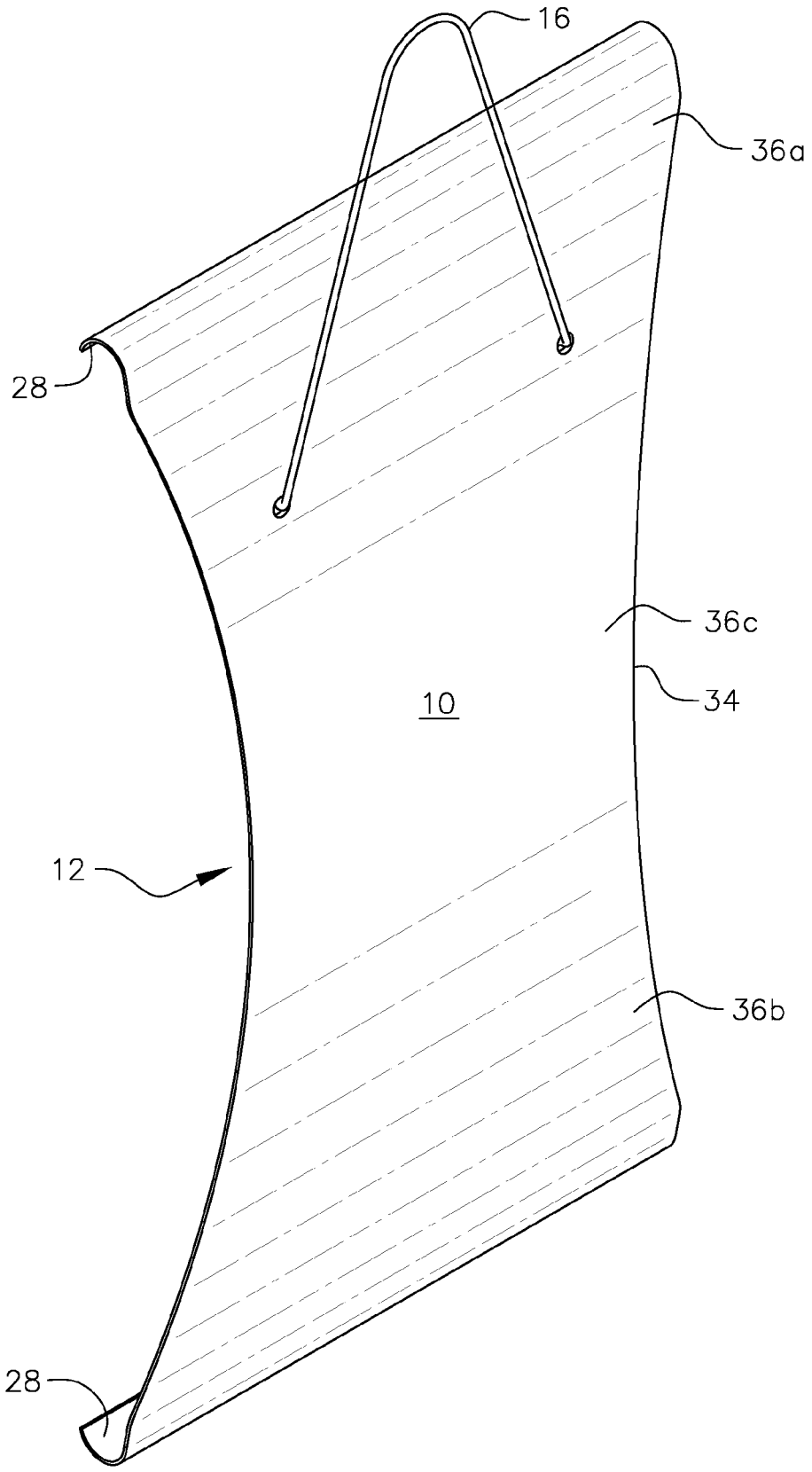
FIG. 9 is a perspective view of an example of another embodiment of the invention depicting a narrower portion of the instrument in middle area and a curved upper and lower edge.
Figure 10A:
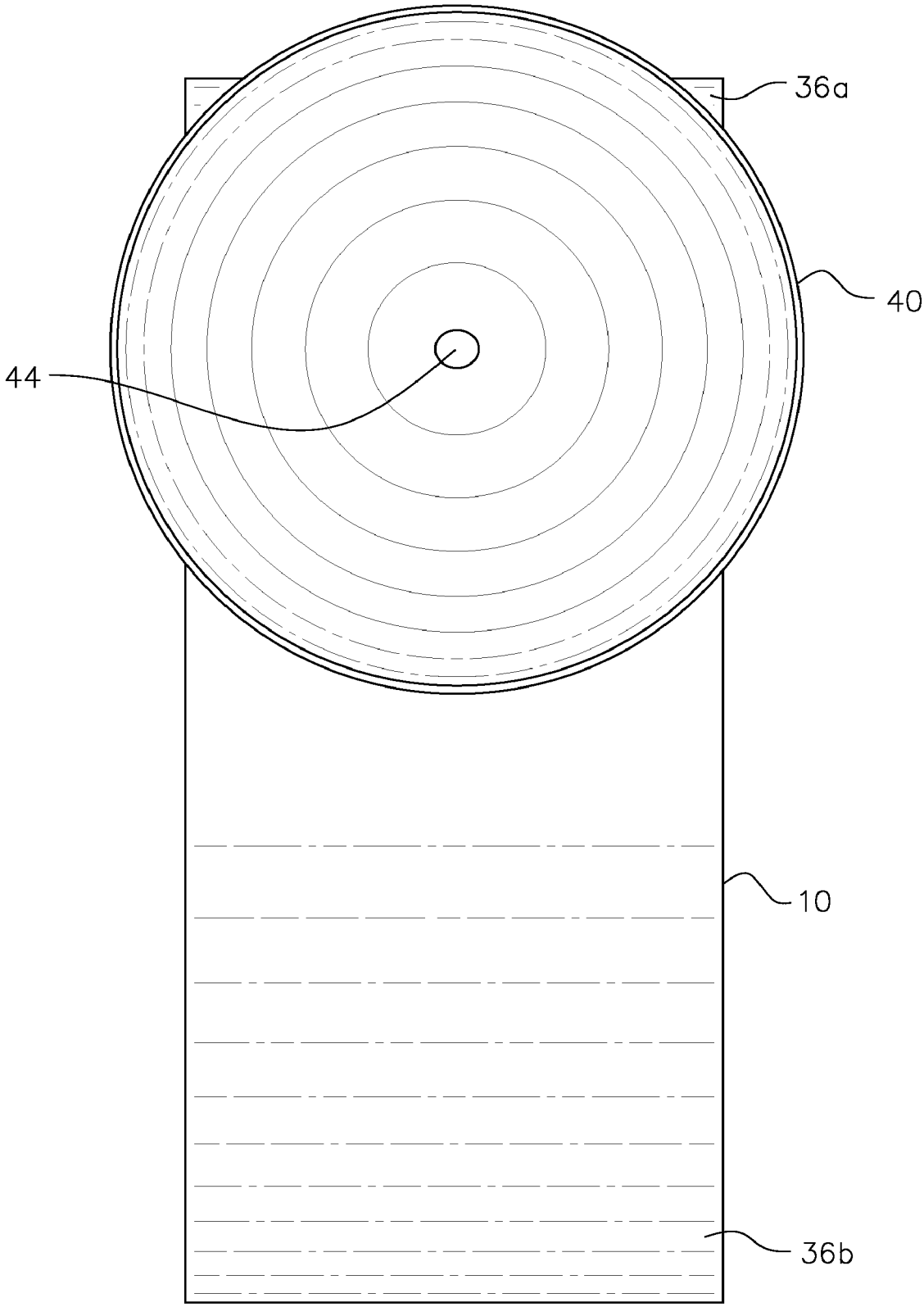
FIG. 10A is a frontal view of an example of another embodiment depicting an object or other instrument, such as a bell or cymbal being fixed to the instrument at a common nodal point with a hole through the common nodal point of each component.
Figure 10B:
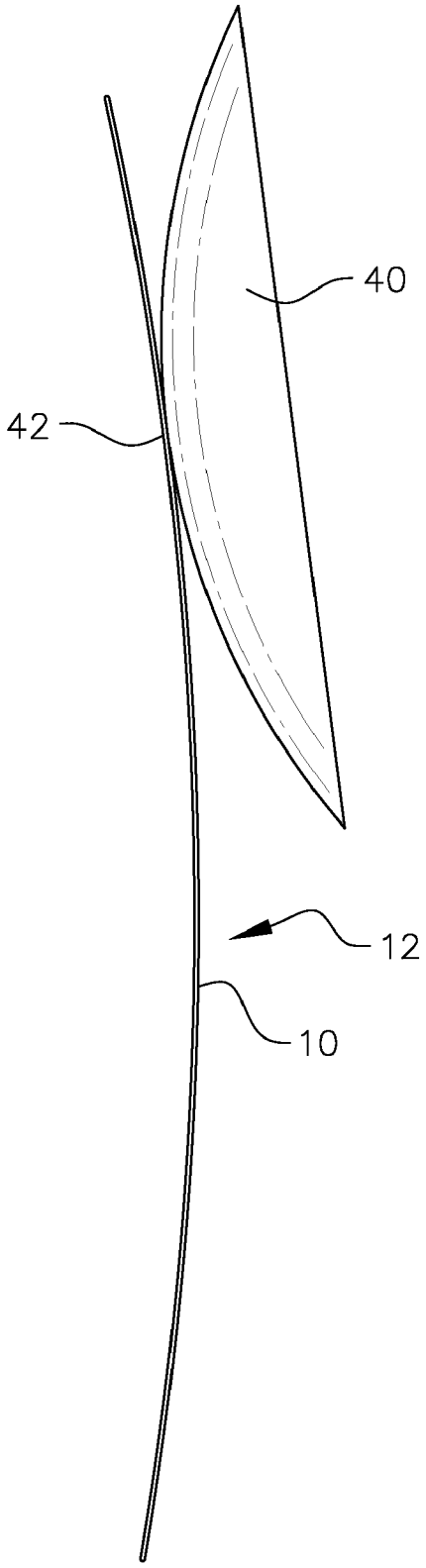
FIG. 10B is a side view depiction of the embodiment of FIG. 10A.
Figure 10C:
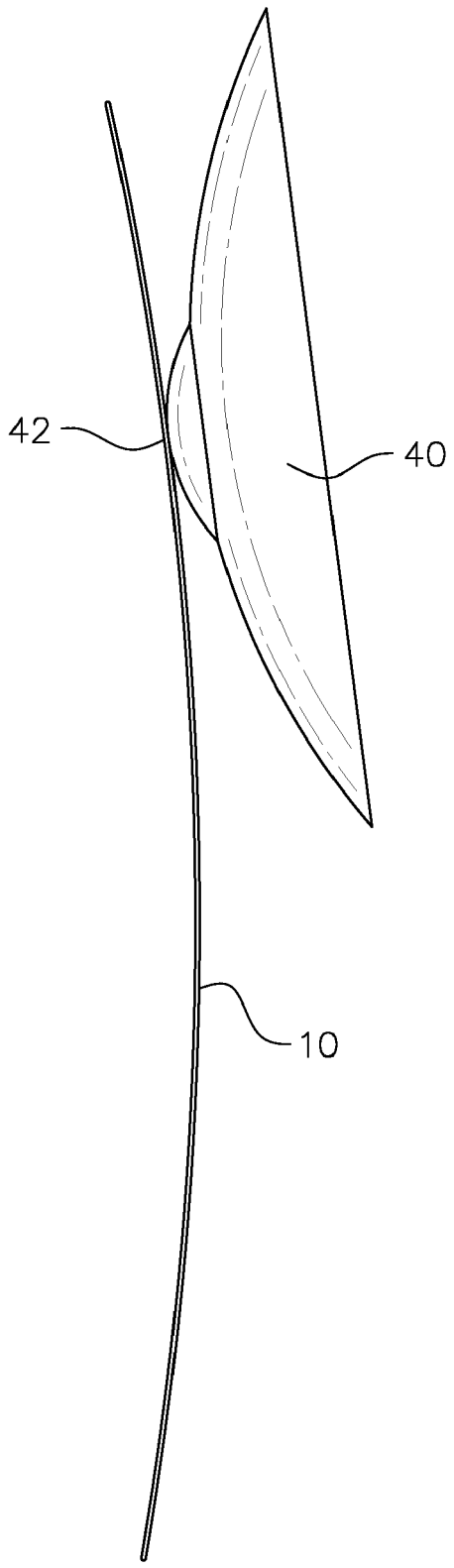
FIG. 10C is a side view depiction of an embodiment similar FIGS. 10A and 10B.
Figure 10D:
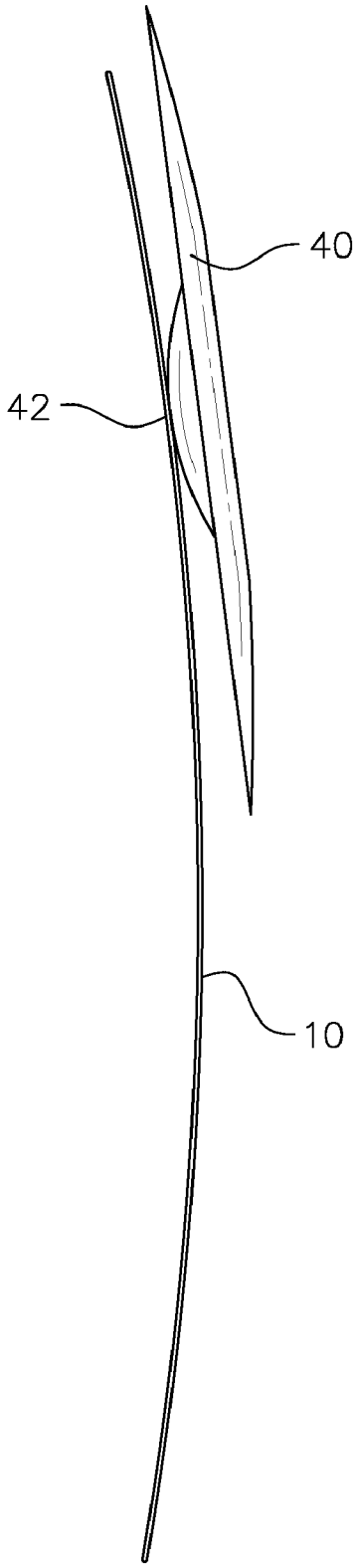
FIG. 10D is a side view depiction of another embodiment similar FIGS. 10A, 10B and 10C.
Figure 11:
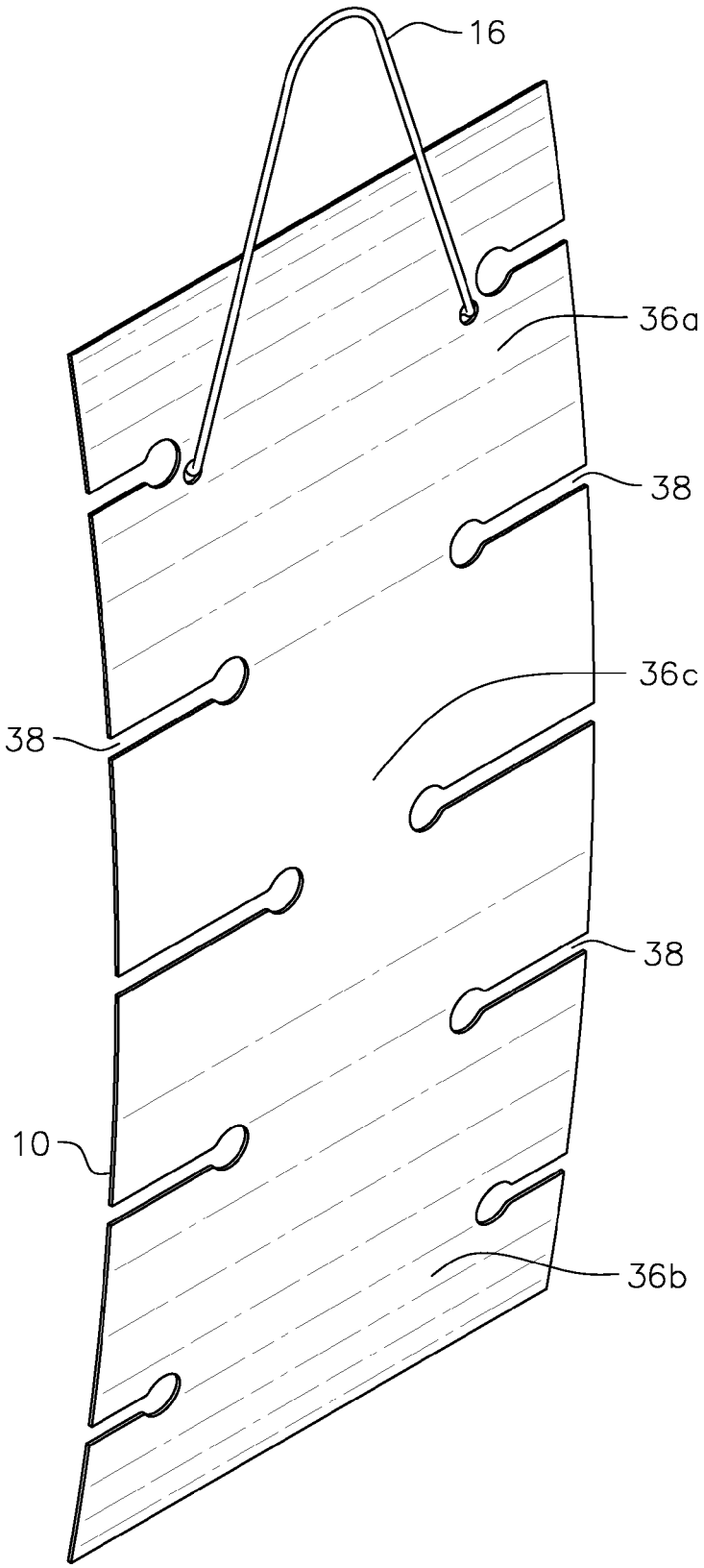
FIG. 11 is a perspective view of another example of an embodiment of the invention depicting by way of example slots, which are progressively deeper toward the middle area of the instrument.
Figure 12A:
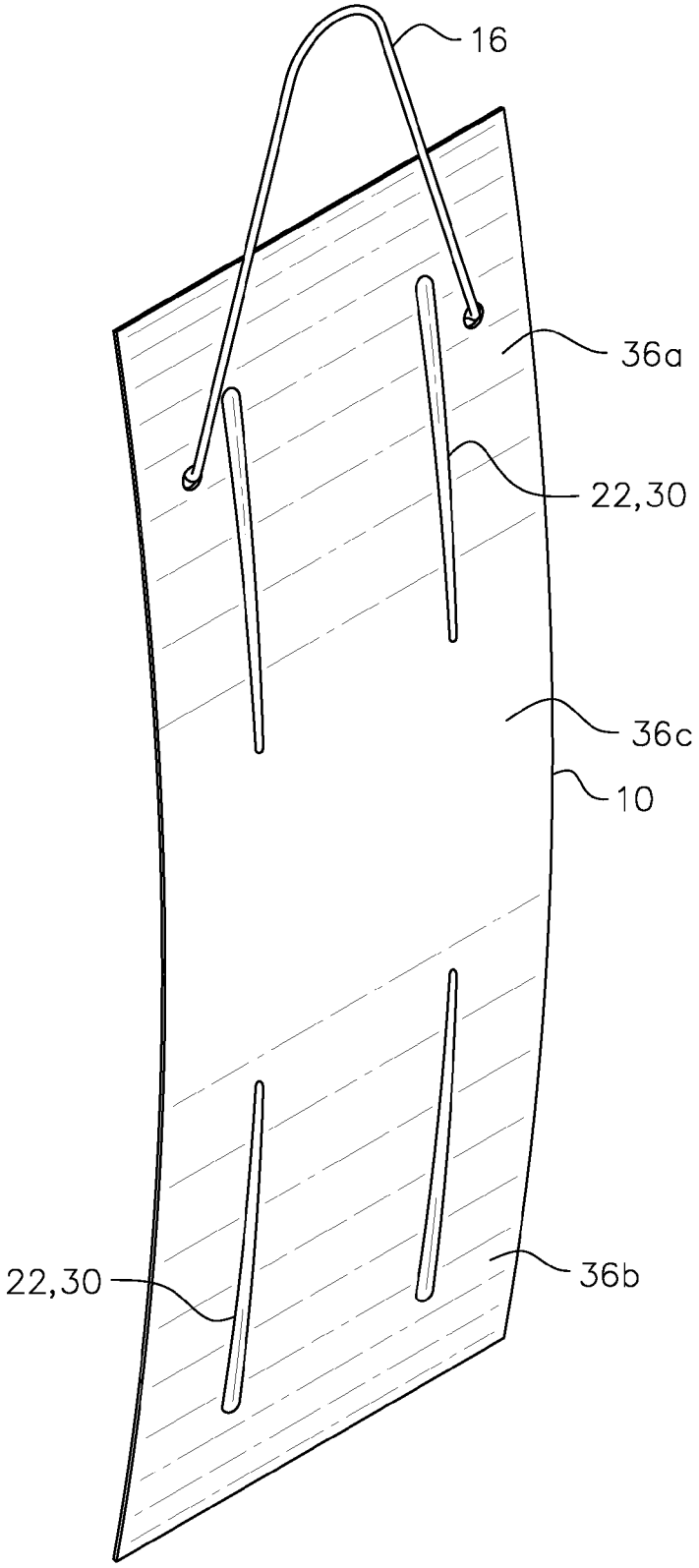
FIG. 12A is a perspective representative view of another example of an embodiment of the invention depicting by way of example welded beads along predetermined portions of the surface of the instrument or formed ribs along predetermined or desired portions of the surface of the instruments or combinations of beads and ribs.
Figure 12B:
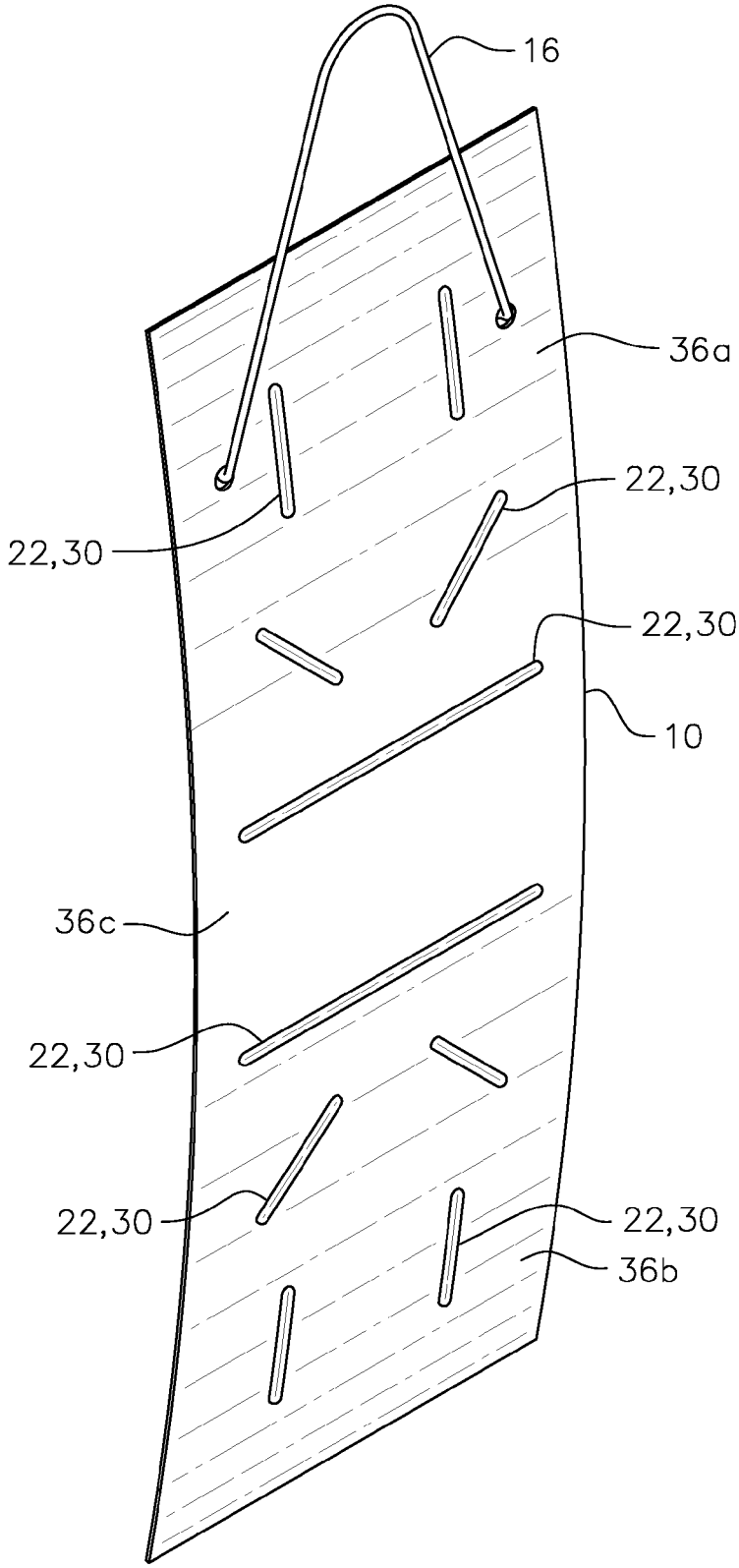
FIG. 12B is a perspective representative view of another example of an embodiment of the invention similar to that depicted in FIG. 12A, depicting by way of example welded beads along predetermined or desired portions of the surface of the instrument or formed ribs along predetermined portions of the surface of the instruments or combinations of beads and ribs.

As shown in the above-delineated and described drawings, by way of example only of various contemplated embodiments of the invention, the invention is a percussion musical instrument 10 comprising means for enhancing the effect known as vibrato wherein a primary bend or curve 12 is permanently formed in the material. The primary curve 12 facilitates an oscillating flexing motion which produces an increase in amplitude of a lowest frequency mode of vibration. The low pitch frequency modulates the whole of a spectrum of a musical sound by repeatedly raising and lowering the spectrum of sound in a periodic or oscillating manner. The instrument 10 is configured and formed to be suspended from one or more points 14 by means of a supporting member 16, which may be a rigid supporting member or a flexible supporting member. The points 14 approximate a nodal area of the lowest frequency mode of vibration wherein the suspension point location increases the amplitude of the vibrato and the nodal area is located at a ratio between about 0.15 and about 0.30 times an overall length of the instrument 10. A preferred nodal area for the instrument 10 is located at a ratio between about 0.20 and about 0.25 times the overall length of said instrument.

In another embodiment, the instrument 10 is formed with multiple primary curves or bends 12, including by way of example only, one or more S-shaped and wave-shaped bends or curves.

In another embodiment of the invention, one or more objects 18,40 are fused or welded to one or both ends 36*a*,36*b* of the instrument 10. The objects 18,40 are configured, formed and located to lower the frequency of vibrato of the instrument 10, alter the location of the nodal area, alter an overtone structure or overall amplitude of the instrument 10 or alter any combination of these characteristics. In a similar embodiment, one or more objects 40 are fused, fastened or welded to one or both ends 36*a*,36*b* wherein the objects 40 are configured, formed and located to lower the frequency of vibrato of the instrument 10, alter the location of the nodal area, alter the overtone structure or overall amplitude of the instrument 10 or alter any combination of these characteristics, and wherein the objects 40 are configured, formed and located to act as independent vibrating members 40 and conduct vibration between a main body of the instrument 10 and the vibrating members 40 and are influenced by the oscillating flexion of the main body to create a bell or cymbal sound with vibrato. Examples of objects 18,40 that may be used in this embodiment include, but not limited to, domes, cantilevers, springs, cymbals, and bells.

In another embodiment, a weight portion 20 of the instrument 10 is formed at one or both ends 36*a*,36*b* or corners of the instrument 10 by the bending or folding of one or more ends or corners of the instrument 10, therein concentrating weight at the ends or corners. The weight portion 20 lowers the frequency of vibrato of said instrument, alters amplitude, alters an overtone structure of said instrument or alters a combination of these characteristics.

In another embodiment, one or more ribs 22 of metal are formed to predetermined portions of the surface the instrument 10. The ribs 22 alter a rigidity, frequency of vibrato, attack or swell, or overtone structure of said instrument, and the ribs 22 are more flexible in a middle area of the instrument 10 by means of being progressively thinner in said middle area than a portion of the ribs 22 extending away from the middle area, or being located directionally to stiffen upper and lower areas 36*a*,36*b* of the instrument 10 more than said middle area 36*c*.

In another embodiment, one or more heat affected zones 24 are provided. These zones 24 alter an overtone structure of the instrument 10 and generally alters a sound character of vibrato by causing a wider range of frequencies to be modulated by the vibrato effect.

In another embodiment, a surface of the instrument 10 is altered to form grooves or areas of varying thickness 26 on predetermined portions of the instrument 10 in which the alterations are less pronounced in a middle area 36*c* of the instrument 10, and more pronounced toward upper and lower ends 36*a*,36*b* of the instrument 10. The middle area 36*c* is more flexible and increases the amplitude and decreases the frequency of vibrato and alters an overtone structure of the instrument 10.

In another embodiment, a folded, flanged or bent edge 28 is provided along one or more areas of the instrument 10. This edge 28 facilitates an increased amplitude of vibrato when struck at an acute angle to the instrument 10. This feature also reduces wear on a drumstick due to a presumably provided rounded, smooth edge 28.

In another embodiment, one or more welded beads 30 of metal are fused or welded to predetermined portions of the surface the instrument 10 wherein the beads 30 alter a rigidity, frequency of vibrato, attack or swell, or overtone structure of the instrument 10, or adds weight to one or more areas of the instrument 10. The beads 30 are provided so as to be more flexible in a middle area 36*c* of the instrument 10 by means of being of thinner gauge in the middle area 36*c* than a portion of the bead 30 extending away from the middle area 36*c*, or being located directionally to stiffen upper and lower areas 36*a*,36*b* of the instrument 10 more than the middle area 36*c*.

In another embodiment, a plurality of surface alterations comprising surface deformations 32 are located on desired portions of the surface of the instrument 10. These surface deformations 32 are smaller or more sparsely located in a middle area 36*c* of the instrument 10 and larger or more densely located in top and bottom areas 36*a*,36*b* of the instrument 10 and they enhance the vibrato effect by rendering the middle area 36*c* more flexible due to the smaller or more sparsely located surface deformations 32.

In another embodiment, a middle portion 34 of the instrument 10 is narrower than upper and lower areas 36*a*,36*b* of the instrument 10. This narrower portion 34 lowers the frequency of vibrato, alters an overtone structure, or alters an amplitude of the instrument or any combination these characteristics.

The instrument 10 is preferably made from material comprising a bronze alloy composed of about 6 to 16 percent tin, said alloy further containing between about 0.02 to 0.50 percent each of nickel and iron for use as grain refining agents, between about 0.005 and 0.70% phosphorous and less than 1% total trace elements, and a remainder being copper. This alloy provides an increase in flexibility or resistance to permanent deformation and enhances an ability of the instrument to produce high amplitude vibrato.

In another embodiment, a plurality of spaced-apart open slots or cuts 38 or two or more are provided at predetermined or desired locations. These slots or cuts 38 typically extend from an outer edge inwardly. The slots or cuts 38 are preferably of a shorter length in bottom and top areas 36*a*,36*b*, and of increasing length toward a middle area 36*c*. This configuration of open slots or cuts 38 make the middle area 36*c* more flexible. Although a single slot would provide some benefits, a preferred embodiment is an instrument incorporating the two or more slots.

In another embodiment, another percussion instrument 40, typically a cymbal, bell or dome-shaped percussion instrument, and a vibrato section of the instrument 10 are fixedly attached (such as by fusing, welding or fastening or other similar methods) at a common nodal area 42, with the nodal area of the vibrato section being located at 0.15 to 0.30 times the length of the vibrato section, and the nodal area of the other percussion instrument 40 being located at a center of the other percussion instrument 40, and the attached sections share a common mounting hole 44.

In another embodiment, material in a middle area 36*c* of the instrument 10 is altered by a hole 46 or a plurality or groups of spaced-apart holes 46 located in predetermined or desired spaced-apart locations. These holes may be shaped as desired, including preferably round and/or elongated. The holes 46 increase an ease of deflecting the instrument 10, lower the frequency of vibrato, or alter an overtone structure of the instrument, or any combination these characteristics.

In another embodiment, a surface alteration 32 is formed on predetermined and/or desired portions of the instrument 10. The surface alteration 32 alters an overtone structure of the instrument and generally alters a sound character of vibrato by causing a wider range of frequencies to be modulated by the vibrato effect. Examples of such alterations 32 are one or more dented, pressed, deformed, bent, hammered, grooved, etched or heat affected zones, or any combination thereof. The unexpected and useful result of such a deformation process is that the modulating effect of the vibrato, with its constant shifting of frequencies provides a decidedly interesting effect never before anticipated in prior art where simple strips of un-hammered metal were shaken or struck to produce a percussive sound.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

I claim:

1. A percussion instrument comprising:

a sheet of highly flexible material having a permanent primary curve formed therein and at least one suspension point being formed approximately within a nodal area of a lowest frequency mode of vibration, such that a pronounced vibrato effect is generated by striking sheet away from the nodal area when suspended from the suspension point;

wherein the material is a bronze alloy composed of about 6 to 16 percent tin, said alloy further containing between about 0.02 to 0.50 percent each of nickel and iron for use as grain refining agents, between about 0.005 and 0.70% phosphorous and less than 1% total trace elements, and a remainder being copper.

2. A method of generating a pronounced vibrato effect, the method comprising:

forming a permanent primary curve in a highly flexible sheet, the sheet having a length and a width;

suspending the sheet from a nodal area of a lowest frequency mode of vibration, the nodal area being located between approximately 0.20 and 0.25 times the length thereof; and striking the sheet away from the nodal area.

3. A percussion instrument comprising:

a sheet of highly flexible material having a length and a width, the sheet of material being permanently curved along at least a portion of the length thereof and a nodal area being located between approximately 0.20 and 0.25 times the length thereof such that a pronounced vibrato effect is generated when striking the sheet away from the nodal area; and suspension means for suspending the sheet of material from the nodal area.

4. The instrument according to claim 3, further comprising:

multiple primary curves or bends, including one or more S-shaped and wave-shaped bends or curves.

5. The instrument according to claim 3, wherein one or more objects are fused or welded to one or both ends of said instrument, wherein said objects are configured, formed and located to lower the frequency of vibrato of said instrument, alter the location of the nodal area, alter an overtone structure or overall amplitude of said instrument or alter any combination thereof.

6. The instrument according to claim 3, wherein one or more objects are fused, fastened or welded to one or both ends wherein said objects are configured, formed and located to lower the frequency of vibrato of said instrument, alter the location of the nodal area, alter the overtone structure or overall amplitude of said instrument or alter any combination thereof, wherein said objects are configured, formed and located to act as independent vibrating members conduct vibration between a main body of the instrument and the vibrating members and are influenced by the oscillating flexion of said main body to create a bell or cymbal sound with vibrato.

7. The instrument according to claim 3, wherein a weight portion of said instrument is formed at one or both ends or corners of said instrument by the bending or folding of one or more ends or corners of the instrument, therein concentrating weight at said ends or corners, wherein said weight portion lowers the frequency of vibrato of said instrument, alters amplitude, alters an overtone structure of said instrument or alters a combination thereof.

8. The instrument according to claim 3, wherein one or more ribs of metal are formed to predetermined portions of the surface said instrument, where said ribs alter a rigidity, frequency of vibrato, attack or swell, or overtone structure of said instrument, and wherein said ribs are more flexible in a middle area of the instrument by means of being progressively thinner in said middle area than a portion of said ribs extending away from said middle area, or being located directionally to stiffen upper and lower areas of the instrument more than said middle area.

9. The instrument according to claim 3, further comprising:

one or more heat affected zones which alter an overtone structure of said instrument and generally alters a sound character of vibrato by causing a wider range of frequencies to be modulated by the vibrato effect.

10. The instrument according to claim 3, wherein a surface of said instrument is altered to form grooves or areas of varying thickness on predetermined portions of said instrument in which said alterations are less pronounced in a middle area of said instrument, and more pronounced toward upper and lower ends of said instrument, wherein said middle area is more flexible and increases the amplitude and decreases the frequency of vibrato and alters an overtone structure of said instrument.

11. The instrument according to claim 3, further comprising:

a folded, flanged or bent edge in along one or more areas of said instrument, wherein said edge facilitates an increased amplitude of vibrato when struck at an acute angle to said instrument.

12. The instrument according to claim 3, wherein one or more welded beads of metal are fused or welded to predetermined portions of the surface of said instrument wherein said beads alter a rigidity, frequency of vibrato, attack or swell, or overtone structure of said instrument, or adds weight to one or more areas of said instrument, and wherein said beads are more flexible in a middle area of the instrument by means of being of thinner gauge in said middle area than a portion of said bead extending away from said middle area, or being located directionally to stiffen upper and lower areas of the instrument more than said middle area.

13. The instrument according to claim 3, further comprising:

a plurality of surface alterations comprising surface deformations, wherein said surface deformations are smaller or more sparsely located in a middle area of said instrument and larger or more densely located in top and bottom areas of said instrument, wherein said surface deformations enhance the vibrato effect by rendering said middle area more flexible due to said smaller or more sparsely located surface deformations.

14. The instrument according to claim 3, wherein a middle portion of said instrument is narrower than upper and lower areas of said instrument, wherein said narrower portion of said instrument lowers the frequency of vibrato, alters an overtone structure, alters an amplitude of said instrument or any combination thereof.

15. The instrument according to claim 3, wherein said instrument is made from material comprising:

a bronze alloy composed of about 6 to 16 percent tin, said alloy further containing between about 0.02 to 0.50 percent each of nickel and iron for use as grain refining agents, between about 0.005 and 0.70% phosphorous and less than 1% total trace elements, and a remainder being copper, wherein said alloy provides an increase in flexibility or resistance to permanent deformation and enhances an ability of said instrument to produce high amplitude vibrato.

16. The instrument according to claim 3, further comprising:

two or more open slots or cuts, extending from an outer edge inward, wherein said slots or cuts are of a shorter length in bottom and top areas, and of increasing length toward a middle area, wherein said configuration of open slots or cuts make said middle area more flexible.

17. The instrument according to claim 3, wherein another percussion instrument and a vibrato section of said instrument are fixedly attached at a common nodal area, with the nodal area of said vibrato section being located at 0.15 to 0.30 times the length of said vibrato section, and the nodal area of said other percussion instrument being located at a center of said other percussion instrument, and wherein said fused sections share a common mounting hole.

18. The instrument according to claim 3, wherein material in a middle are of said instrument is altered by one or more holes, wherein said one or more holes increase an ease of deflecting said instrument, lower the frequency of vibrato, alter an overtone structure of said instrument, or any combination thereof.

19. The instrument according to claim 3, further comprising:

a surface alteration formed on portions of said instrument, wherein said surface alteration alters an overtone structure of said instrument and generally alters a sound character of vibrato by causing a wider range of frequencies to be modulated by the vibrato effect.

20. The instrument according to claim 3, wherein a surface alteration formed on portions of said instrument comprises one or more dented, pressed, deformed, bent, hammered, abraded, compressed, slotted, folded, grooved, etched or heat affected zones, or any combination thereof.

21. The instrument according to claim 3, further comprising at least one additional curve formed along the width of the sheet of material, a curvature of the additional curve being sufficiently small to prevent obliteration of the vibrato effect.

* * * * *